US008648770B2

(12) United States Patent
Schneider et al.

(10) Patent No.: US 8,648,770 B2
(45) Date of Patent: Feb. 11, 2014

(54) SMART ANTENNA SYSTEMS SUITABLE FOR RECEPTION OF DIGITAL TELEVISION SIGNALS

(75) Inventors: Richard E. Schneider, Wildwood, MO (US); John Edwin Ross, III, Moab, UT (US); David E. Young, Pennsylvania Furnace, PA (US); David P. Koller, State College, PA (US)

(73) Assignee: Antennas Direct, Inc., Ellisville, MO (US)

( * ) Notice: Subject to any disclaimer, the term of this patent is extended or adjusted under 35 U.S.C. 154(b) by 347 days.

(21) Appl. No.: 13/062,624

(22) PCT Filed: Sep. 4, 2009

(86) PCT No.: PCT/US2009/056128

§ 371 (c)(1),
(2), (4) Date: Mar. 21, 2011

(87) PCT Pub. No.: WO2010/028309

PCT Pub. Date: Mar. 11, 2010

(65) Prior Publication Data

US 2011/0163936 A1 Jul. 7, 2011

Related U.S. Application Data

(60) Provisional application No. 61/191,111, filed on Sep. 5, 2008.

(51) Int. Cl.
*H01Q 21/00* (2006.01)

(52) U.S. Cl.
USPC ..... 343/893

(58) Field of Classification Search
USPC ..... 343/893
See application file for complete search history.

(56) References Cited

U.S. PATENT DOCUMENTS

| | | | |
|---|---|---|---|
| 2,220,008 | A | 10/1940 | Woodward et al. |
| 2,437,251 | A | 3/1948 | Frische et al. |

(Continued)

FOREIGN PATENT DOCUMENTS

| | | |
|---|---|---|
| JP | 06-104629 | 4/1994 |
| JP | 06/112728 | 4/1994 |
| WO | WO 03/094290 | 11/2003 |

OTHER PUBLICATIONS

Notice of Allowance issued by the United States Patent and Trademark Office dated Jun. 14, 2011, from pending U.S. Appl. No. 12/953,007, which shares two of the same inventors, Richard E. Schneider and John E. Ross, as the instant application (7 pages).

International Search Report and Written Opinion from the PCT Application No. PCT/US2009/056128 (published as WO 2010/028309) which is related to the instant application through a priority claim; dated May 26, 2010; 17 pages.

(Continued)

*Primary Examiner* — Kristy A Haupt
(74) *Attorney, Agent, or Firm* — Harness, Dickey & Pierce, P.L.C.

(57) ABSTRACT

A reconfigurable antenna is disclosed that includes a ground plane, an electrically-conductive microstrip patch element, and a plurality of switches. The patch element is spaced-apart from the ground plane with a dielectric medium between the patch element and the ground plane. The switches are coupled between the ground plane and the patch element. The switches are openable and closable, for example, in response to a control signal from an external television device to configure the state of the reconfigurable antenna. Additional reconfigurable antenna elements are disclosed. Antenna arrays including reconfigurable antenna elements, switchable fixed elements, or a combination thereof are also disclosed.

42 Claims, 36 Drawing Sheets

(56) References Cited

U.S. PATENT DOCUMENTS

| | | | | |
|---|---|---|---|---|
| 2,589,578 | A | 3/1952 | Sabins | |
| 3,828,867 | A | 8/1974 | Elwood | |
| 7,151,491 | B2 * | 12/2006 | Jacquinot | 343/700 MS |
| 7,693,570 | B2 | 4/2010 | Green et al. | |
| 7,898,496 | B2 | 3/2011 | Olsen et al. | |
| 2002/0126052 | A1 | 9/2002 | Boyle | |
| 2005/0264455 | A1 * | 12/2005 | Talvitie et al. | 343/702 |
| 2008/0007460 | A1 * | 1/2008 | Ke et al. | 343/700 MS |

OTHER PUBLICATIONS

Catching Waves; St. Louis Business Journal; vol. 28, No. 35; Apr. 25-May 1, 2008; 1 page.

Nonfinal Office Action (dated May 25, 2011) from U.S. Appl. No. 12/953,007 which names two of the same inventors, Richard E. Schneider and John Edwin Ross III, as the instant application but are not related through a priority claim, 6 pages.

* cited by examiner

SMART ANTENNA SYSTEMS SUITABLE FOR RECEPTION OF DIGITAL TELEVISION SIGNALS

CROSS REFERENCE TO RELATED APPLICATION

This application is a 371 of PCT International Application No. PCT/US2009/056128 filed Sep. 4, 2009, published as WO 2010/056128 on Mar. 11, 2010, which claims priority to U.S. provisional patent Application No. 61/191,111 filed Sep. 5, 2008. The entire disclosures of the above applications are incorporated herein by reference.

FIELD

The present disclosure generally relates to smart and/or reconfigurable antenna systems, such as indoor smart antenna systems usable or suitable for reception of digital television signals.

BACKGROUND

This section provides background information related to the present disclosure which is not necessarily prior art.

Many people enjoy watching television. Recently, the television-watching experience has been greatly improved due to high definition television (HDTV). A great number of people pay for HDTV through their existing cable or satellite TV service provider. In fact, many people are unaware that HDTV signals are commonly broadcast over the free public airwaves. This means that HDTV signals may be received for free with the appropriate antenna.

Some known television antennas are tuned, or optimized, for a certain resonant frequency. The gain of such antennas is greatest around the resonant frequency and generally decreases for signals with frequencies farther away from the resonant frequency. Additionally, some antennas have a radiation pattern that is fairly directional, which may cause a user to need to reorient the antenna to receive signals broadcast from different locations.

SUMMARY

This section provides a general summary of the disclosure, and is not a comprehensive disclosure of its full scope or all of its features.

According to one aspect of the present disclosure, a reconfigurable antenna is disclosed that includes a ground plane and an electrically-conductive microstrip patch element. The patch element is spaced-apart from the ground plane with a dielectric medium between the patch element and the ground plane. Switches may be coupled between the ground plane and the patch element. The switches may be openable and closable, for example, in response to a control signal from an external television device to configure the state of the reconfigurable antenna. Additional reconfigurable antenna elements are disclosed. Antenna arrays including reconfigurable antenna elements, switchable fixed elements, or a combination thereof are also disclosed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The Consumer Electronics Association (CEA) has published a standard for an antenna control interface for receiving terrestrial transmissions known as CEA-909 and a revision of the standard known as CEA-909-A. A purpose of the standard is to facilitate television reception through the use of reconfigurable or smart antennas. In such a scheme, a receiver controls the antenna for best reception by adjusting the antenna's configuration. The revised standard CEA-909-A specifies use of a single wire for both the signals received by the antenna and communication between a receiver and the antenna. Antenna configuration is neither specified nor implied in the CEA-909 and CEA-909-A standards.

Figure 1:
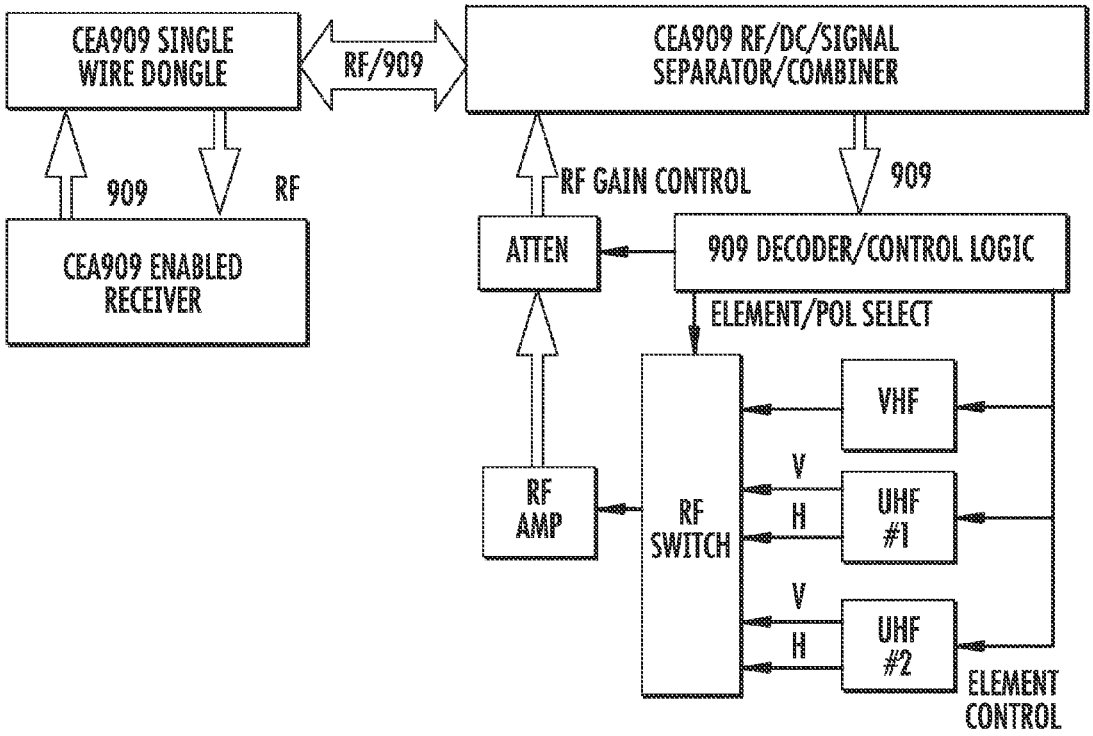
FIG. 1 is a block diagram of a CEA-909-A compliant single wire smart antenna operating with a CEA-909 enabled receiver.

A block diagram of a CEA-909-A compliant single wire smart antenna operating with a CEA-909 enabled receiver is shown in FIG. 1. The CEA909 Single Wire Dongle combines the RF and 909 6-wire signals to the 909A single wire standard. On the antenna, the combined signals are separated into DC, 909, and RF components. The 909 signals are decoded and control logic selects the proper element and polarization (as indicated by ELEMENT/POL SELECT in FIG. 1), adjusts the attenuator (ATTEN), and tunes the selected element for optimum performance on the selected channel. While FIG. 1 shows only one VHF antenna element and two UHF antenna elements, additional elements may be included with commensurate increase in size and cost. In FIG. 1, each UHF antenna element is dual polarized such that V represent vertical polarization and H represent horizontal polarization. In some embodiments, a polarization selection switch may be resident on the element. Element tuning can be limited to particular antenna elements or eliminated all together depending on desired performance and cost objectives. A phasing module to control beam steering may also be included in some embodiments. Also, some embodiments are configured for indoor use and include the ability to switch polarizations, for example, to accommodate for depolarization that may occur with indoor signals due to multiple reflections and diffractions encountered between the transmitter antenna and the indoor antenna.

The inventors disclose herein embodiments of smart antenna systems operable across the Post 2009 digital television (DTV) frequency bands of 174 megahertz to 216 megahertz and from 470 megahertz to 698 megahertz. The smart antenna system may be configured to be in full compliance with the CEA-909A single wire control interface standard. The smart antenna systems provide performance equal or better than a tuned rabbit ear antenna (approximately 0 dBi) on VHF bands. The smart antenna systems are also capable of fitting in a form factor smaller than 20 in×10 in×12 in or equivalently 50.8 cm×25.4 cm×30.5 cm. Also disclosed are alternative embodiments of smart antenna systems configured differently such as with a smaller or larger size and/or with different performance. Moreover, embodiments disclosed herein may be configured to be operable with other frequencies and/or frequency ranges beside the Post 2009 DTV frequency bands. By way of example, a smart antenna system may be configured for operation with one or more military frequency or frequency bands.

In preferred embodiments (e.g., FIG. 18, etc.), a smart antenna system includes dual-polarized tunable microstrip disc antenna elements. Although microstrip disc antenna elements are preferred in some embodiments, other embodiments may include other antenna elements. Accordingly, various arrangements and methods of utilizing of different antenna elements including other reconfigurable antenna elements and fixed geometry/non-configurable antenna elements will now be discussed with reference to FIGS. 2 through 17.

Figure 2:
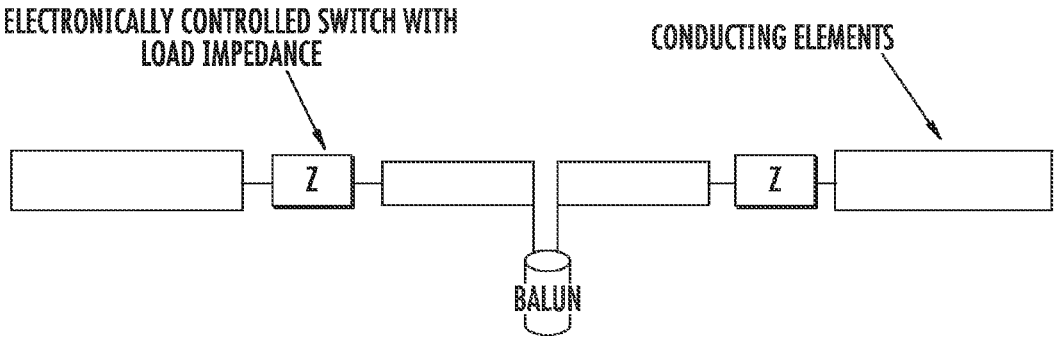
FIG. 2 is a reconfigurable dipole antenna.

FIG. 2 illustrates an exemplary reconfigurable dipole antenna. As shown, the antenna has wire segments connected by one or more electronically controlled switches. Loading elements may be included as well to allow the element to tune across one or more bands. A balun is provided to suppress undesired radiation from currents that arise on the outer conductor of coaxial feed lines. The balun, not necessarily of the 75:300 ohm variety, may also assist in matching impedance of the antenna to the feed line.

The basic dipole does not provide a lot of gain. With proper loading, however, it can be configured to operate reasonably efficiently in one or more of the digital television (DTV) bands. Depending on the target frequency band, the form factor of the antenna may be relatively small as compared to some alternative antenna configurations. Additionally, the dipole antenna element may be bent to fit into a more compact form.

Figure 3:
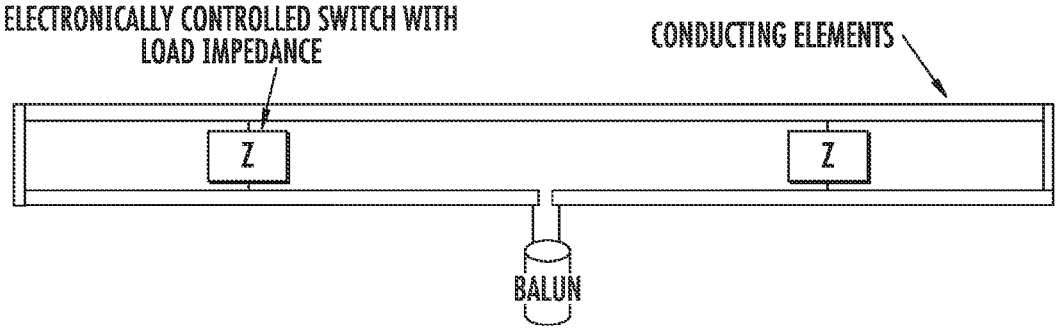
FIG. 3 is a reconfigurable folded dipole antenna.

FIG. 3 illustrates an exemplary reconfigurable folded dipole antenna. Unlike the antenna shown in FIG. 2 with serially connected radiating elements, the antenna shown in FIG. 3 uses switches and loads coupled in parallel across the folded dipole antenna element. The reconfigurable folded dipole has a broader bandwidth than an equivalent size dipole for each configuration state. The enhanced bandwidth for each state makes a reconfigurable folded dipole more forgiving than a simple dipole.

Figure 4:
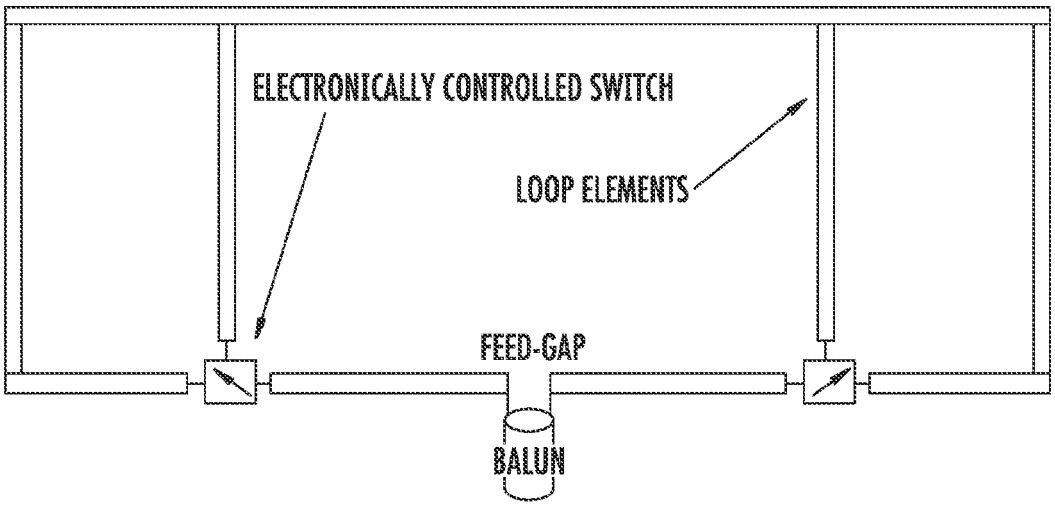
FIG. 4 is a reconfigurable loop antenna.

FIG. 4 illustrates an exemplary reconfigurable loop antenna element in which electronically controlled switches are used to select loops of various sizes. Switches can be located at various locations to effect multiple loop structures as desired. The loop structure of the antenna shown in FIG. 4 may provide better gain and better bandwidth than reconfigurable dipole elements. The switching elements may be placed relative to the loop element so as to minimize or reduce the coupling of control, power, and ground lines.

A reconfigurable loop element may also be combined with a suitably sized reflector. Because loop size is adjustable, separation distance between the loop and the reflector may be reduced substantially as compared to other non-reconfigurable antenna designs. Such reduction of the separation distance can be accomplished while maintaining, or even slightly increasing, gain to about 9 dBi (decibel isotropic) for a single loop. The beam width of such a reconfigurable loop element/reflector is about 70 degrees. The narrow spacing between the loop and the reflector may decrease bandwidth. But selecting different size loops of the reconfigurable loop element via CEA-909-A communication may allow coverage of the desired frequency range.

The number of states included in the reconfigurable loop antenna is determined based on the bandwidth of each state and the width of the desired frequency band, such as the UHF band. In some embodiments, the reconfigurable loop element has a thickness of about 1 inch (~25 mm). Such a thin element may be limited due to bandwidth and impedance issues. The reconfigurable loop-reflector element may be configured so as to account for (e.g., reduce the effect of) coupling of control, power, and ground lines. Additionally, FIG. 4 also illustrates a balun at the feed point of the reconfigurable loop element.

Figure 5:
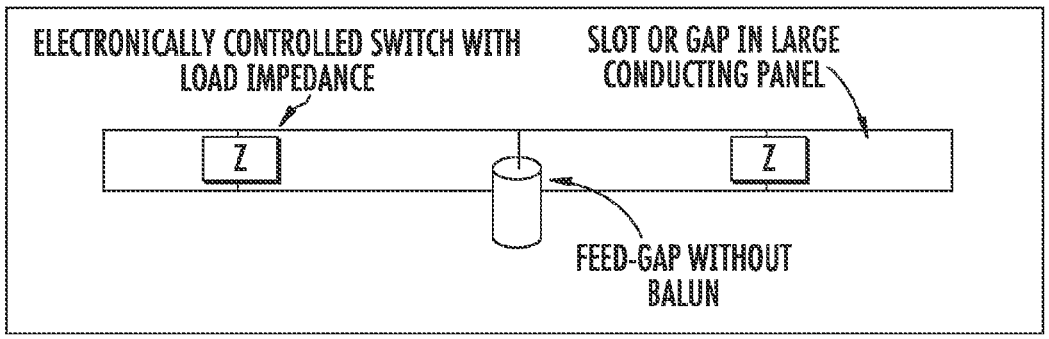
FIG. 5 is a reconfigurable slot antenna.

FIG. 5 illustrates an exemplary reconfigurable slot antenna or radiator. The slot is the electromagnetic dual of the dipole with different polarization and radiation patterns from the dipole. The slot does not necessarily need to be linear, as the slot may be shaped as desired to achieve the desired radiation pattern and bandwidth. In operation, the slot may radiate equally to both sides of the panel.

In some embodiments, the reconfigurable slot antenna provides a 75 ohm impedance directly without the need for a balun. This can improve efficiency and may reduce costs. Additionally, the reconfigurable slot antenna naturally provides shielding, which may help decouple the control, power, and ground lines from the radiating element.

Generally, the conducting panel of the reconfigurable slot antenna should be as large as possible to ensure that the enclosed slot operates properly. Small conducting panels may also be used. But small conducting panels may result in pattern distortion and detuning of the slot due to reflections and radiation from the edge of the panels. The particular shape, orientation, and size of the slot will depend, at least in part, on the particular configuration (e.g., shape, size, etc.) of the conducting panel.

Figure 6:
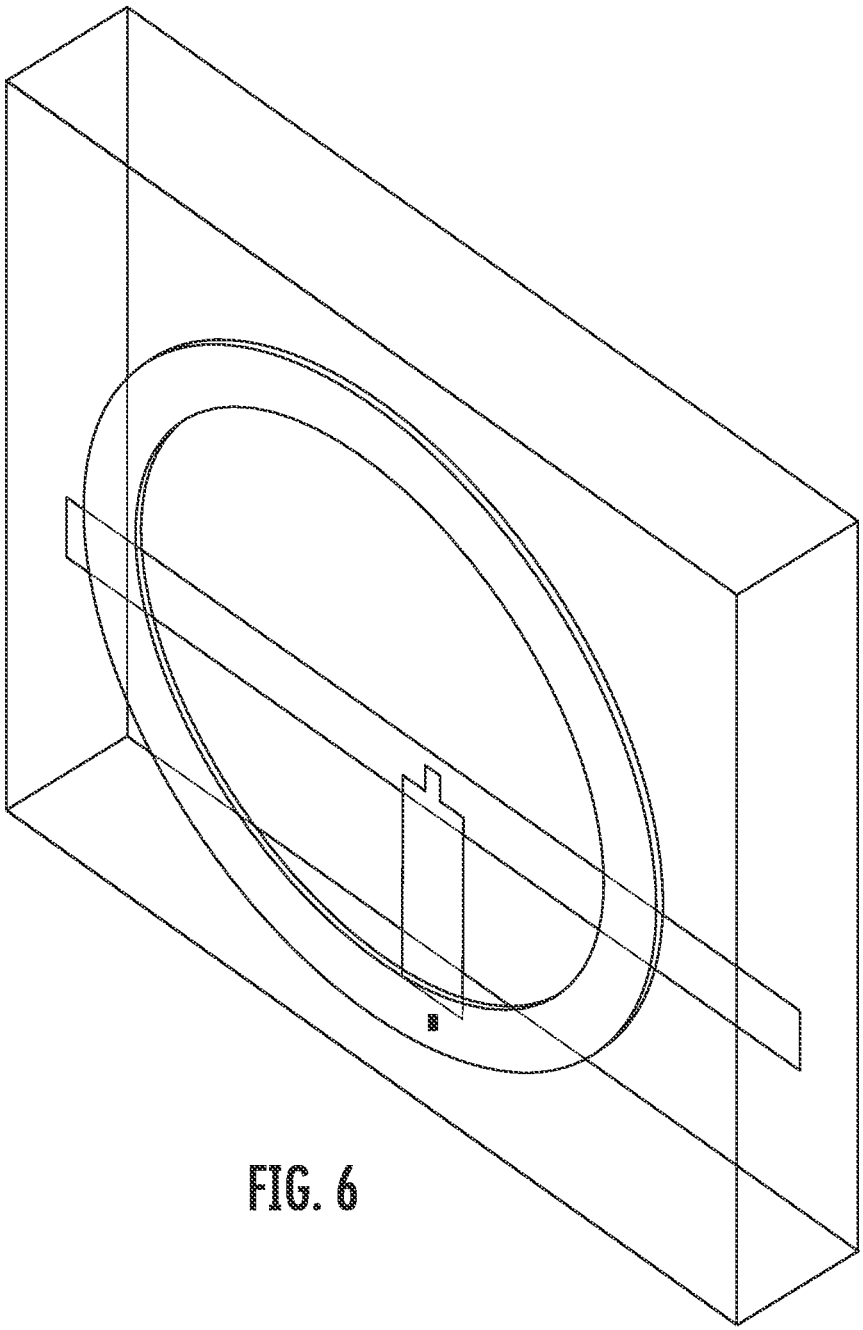
FIG. 6 is an exemplary cavity backed slot antenna.
Figure 7:
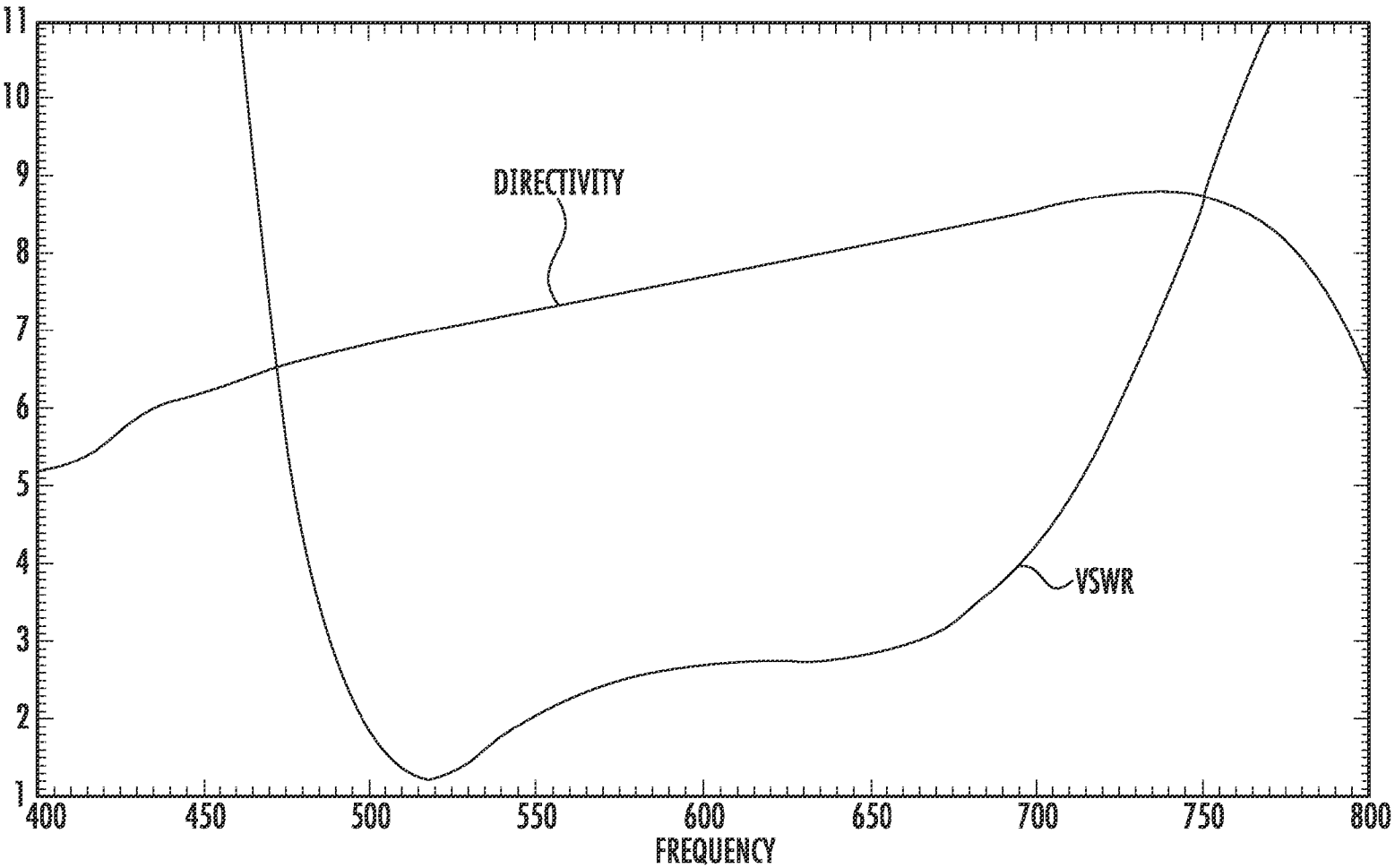
FIG. 7 is a graph of directivity and voltage standing wave ratio (VSWR) versus frequency over a bandwidth from 400 megahertz to 800 megahertz for the cavity backed slot antenna of FIG. 6, where the square reference points indicate directivity and the crosses represent VSWR.

FIG. 6 illustrates an exemplary cavity backed slot antenna. The cavity backed slot radiates primarily toward the open side of the cavity and exhibits enhanced gain over an open slot element. The bandwidth and performance depend both on the slot configuration as well as the size and proportions of the cavity. For compact applications, the size of the ground screen/panel may also affect performance. The cavity backed slot antenna illustrated in FIG. 6 includes a 300 millimeter (mm)×300 mm×50 mm cavity and is fed using a T-bar feed. The T-bar feed is used to provide enhanced impedance bandwidth in the cavity backed slot element. The directivity and VSWR versus frequency for the cavity backed slot antenna are shown in FIG. 7 in which the vertical axis begin at 1 and ends at 11 and the horizontal axis is from 400 Megahertz (Mhz) to 800 Mhz (in 50 MHz increments).

Figure 8:
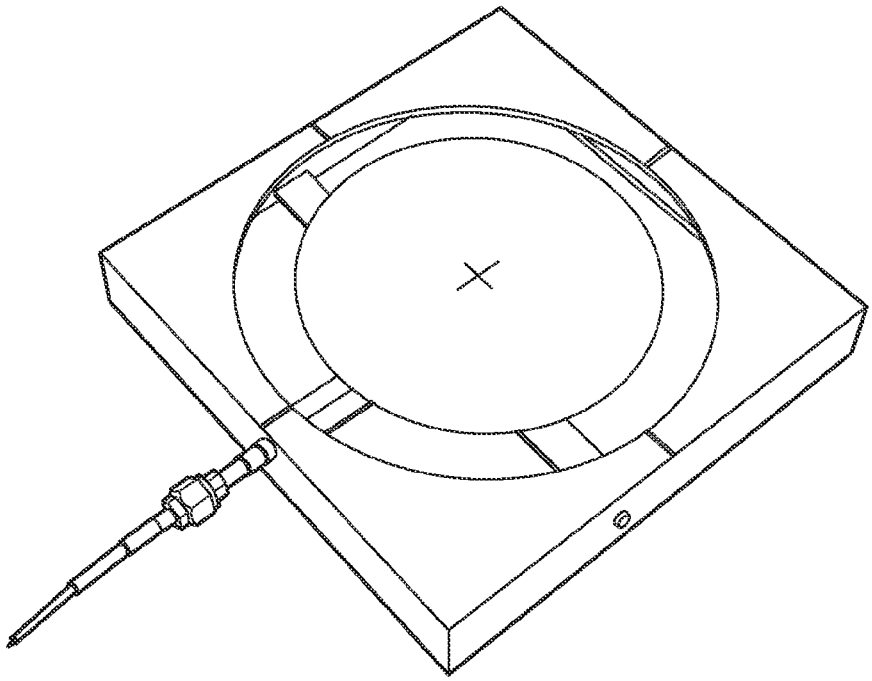
FIG. 8 illustrates an exemplary cavity backed slot antenna.

FIG. 8 is a prototype of an exemplary cavity backed circular slot antenna with a T-bar feed, which was constructed and tested for the UHF bands.

The antenna prototype exhibited performance consistent with computer predictions. Despite having a low profile, a cavity backed slot antenna is capable of providing good bandwidth and directivity across most of the UHF DTV band. Alternative, or additionally, other feed methods besides T-bar feeds may be used with cavity backed slot antennas, such as loop feeds, probe feeds, or other loading or feeding methods disclosed herein, etc.

Figure 9:
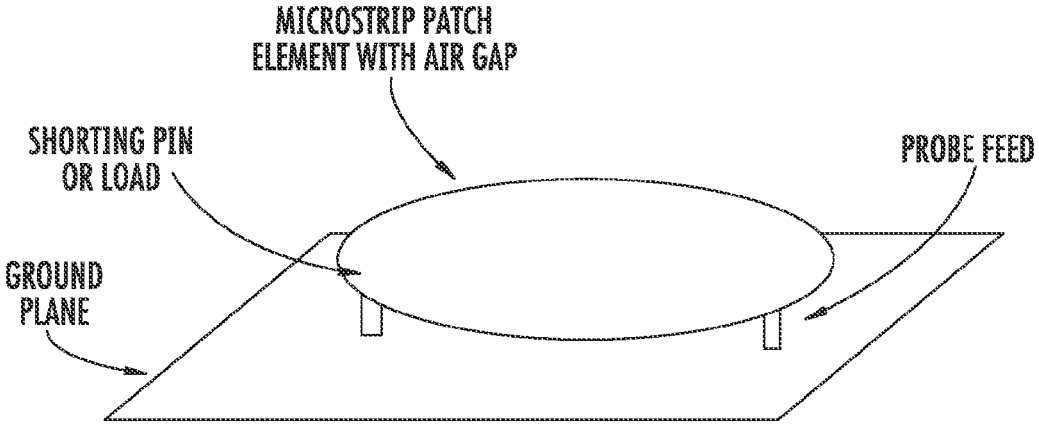
FIG. 9 is a reconfigurable microstrip antenna having a microstrip circular patch element disposed above a ground plane with an air gap between the microstrip circular patch element and ground plane.

FIG. 9 illustrates an exemplary reconfigurable microstrip antenna in which a microstrip patch element is disposed, supported, or suspended over a ground plane or reflector. In this example, a circular disc patch is shown, but other patch geometrics may be used in other embodiments, such as squares, rectangles, ellipses, triangles, etc. The particular shape of the patch element may be based on the desired pattern, polarization, bandwidth, and antenna size constraints. Depending on the particular embodiment, a microstrip antenna may be configured for use as an indoor television antenna for receiving UHF signals.

As mentioned above, the reconfigurable microstrip antenna includes a patch element spaced apart from a ground plane. A dielectric medium occupies the space between the ground plane and the patch element. In the illustrated embodiment of FIG. 9, air is the dielectric medium between the ground plane and patch element. But other dielectric media (e.g., electrically nonconductive material, etc.) may also be used in other embodiments. The illustrated configuration of the reconfigurable microstrip antenna achieves good bandwidth for UHF television. The reconfigurable microstrip antenna may be fed using microstrip lines from the lateral side of the element or from beneath using probe feeds. The bandwidth of the element decreases as the gap or thickness of the dielectric medium decreases. Increasing the gap or dielectric medium's thickness, however, will increase the probe inductance, which detunes the antenna element. To compensate for the probe inductance, a series capacitance may be included with the probe. The capacitor may be implemented as a parallel plate capacitor placed at the top of the probe. Probe inductance can also be decreased by increasing the diameter of the probe or using conical probes. The input impedance of the antenna element can be increased or decreased by adjusting placement of the probe relative to the edge of the disc. Feed locations near the edge have generally higher impedance than those nearer the center.

With continued reference to FIG. 9, one or more switches may be coupled between the patch element and the ground plane via shorting pins at various points on the patch element. The switches can be any suitable switch, such as MOSFETs, PIN diodes, MEMS switches, RF relays, or mechanical relays. Shorting a pin to ground by turning on (or closing) a switch increases the resonant frequency. Shorting pins near the center of the patch element causes small shifts in resonant frequency. Shorting pins near the edge causes larger shifts. Shorting more than one pin causes an additive effect in the frequency shift. The number of resonant frequencies that can be selected is determined by the number of shorting pins, and therefore the number of switches, for coupling the patch element to ground. Ignoring multiple polarization scheme (which will be discussed below) for the moment, the number of selectable resonant frequencies for the reconfigurable microstrip antenna element having n switches is $2^n$, where n is a whole number.

In the reconfigurable microstrip antenna shown in FIG. 9, shorting pins are generally set along a line that passes through the feed point and the center of the disc. The pins are generally spaced from the feed point (or points). Placement of too many shorting pins near the feed point detunes the device and may inhibit proper operation. Pins may be located on both the same side and the opposite side as the feed location.

Dual polarization operation is possible by placing additional feed and shorting pins on a line orthogonal to the first. Performance is generally unaffected provided that the feed port and shorting pins for the unused polarization are open. In a dual polarization configuration, the number of selectable resonant frequencies for the reconfigurable microstrip antenna having n switches in a first line and m switches in a second line perpendicular to the first line is $2^m$ in a first polarization and $2^n$ in the second polarization. Such a reconfigurable microstrip antenna has $2^m+2^n$ selectable states.

Unlike reconfigurable dipoles (e.g., FIGS. 2 and 3, etc.) and reconfigurable loops (e.g., FIG. 4, etc.), the control, power, and ground traces used to drive the switching elements of the reconfigurable microstrip antenna shown in FIG. 9 may be electrically shielded from the radiating element by the ground plane. Thus, the performance of the reconfigurable microstrip antenna is generally not dependent on placement and routing of traces used in the electronics.

Figure 10:
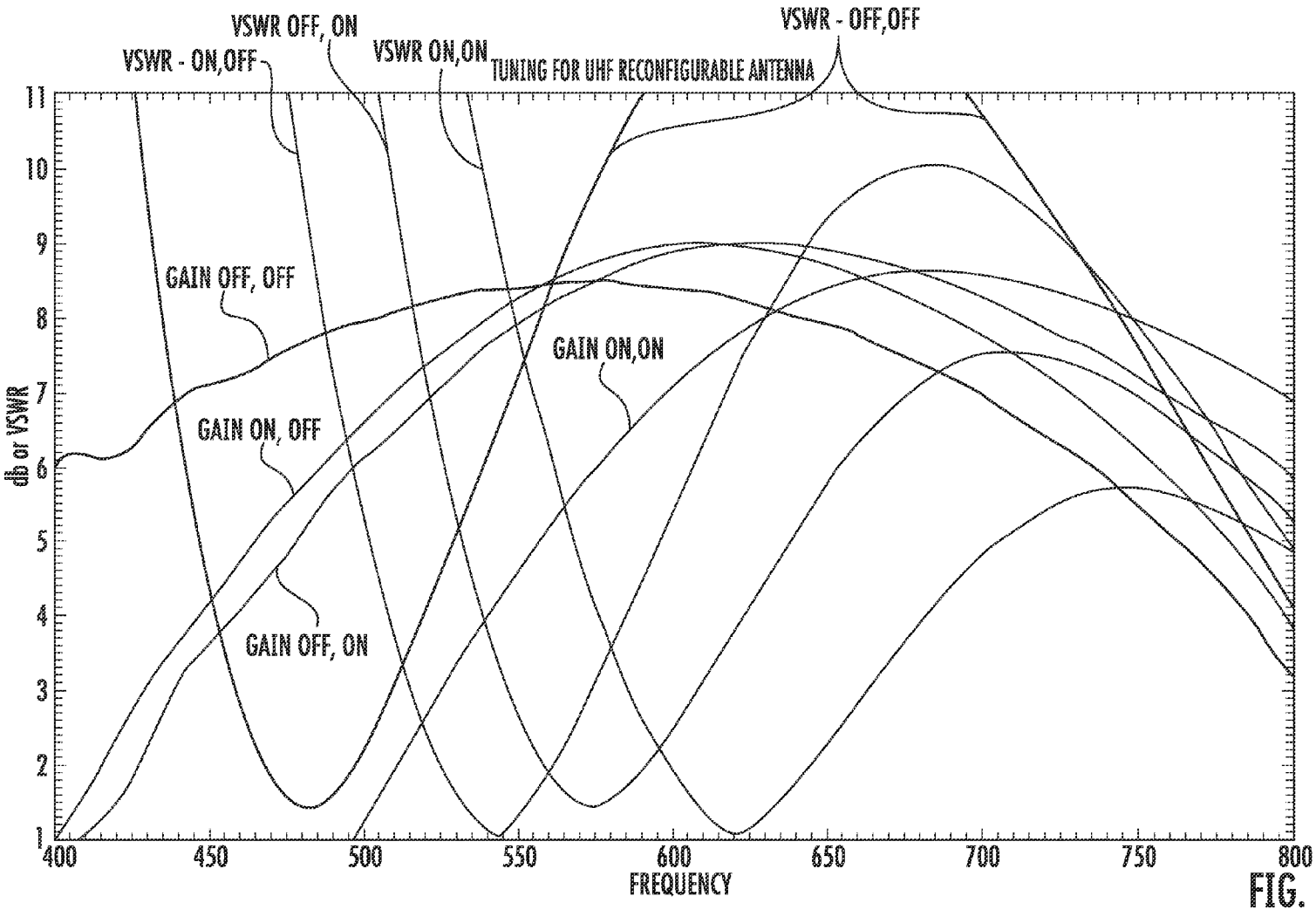
FIG. 10 is a graph of VSWR and directivity versus frequency over a bandwidth of 400 megahertz to 800 megahertz for a reconfigurable microstrip antenna having a single polarization and four selectable states.

In an example embodiment, there is provided a singly polarized reconfigurable microstrip antenna that includes two shorting pins and associated switches. Thus, this example reconfigurable microstrip antenna element has four states or resonant frequencies. Continuing with this example, the ground plane is approximately 250 mm×250 mm. This relatively small ground plane size may result in edge effects and coupling to the antenna element. This reconfigurable microstrip antenna includes a circular patch element spaced apart or above the ground plane by about 50 mm. The bandwidth of each state is relatively wide. Plots of the VSWR and directivity for such a reconfigurable microstrip antenna are shown in FIG. 10 in which the vertical axis begins at 1 (VSWR or decibels) and ends at 11 (VSWR or decibels) and the horizontal axis is from 400 Mhz to 800 Mhz (in 50 MHz increments). Specifically, FIG. 10 illustrates VSWR and gain curves for the computed tuning states for the UHF reconfigurable disc antenna with a 50 mm air gap associated with four different states or resonant frequencies. From left-to-right in FIG. 10, the VSWR curves for the reconfigurable microstrip antenna are shown when both switches are off (off, off), when the first switch is on and the second switch is off (on, off), when the first switch is off and the second switch is on (off, on), and when both switches are on (on, on). Likewise, FIG. 10 also illustrates the gain curves for the reconfigurable microstrip antenna when both switches are off (off, off), when the first switch is on and the second switch is off (on, off), when the first switch is off and the second switch is on (off, on), and when both switches are on (on, on).

In other embodiments, the patch element is separated from the ground plane by 25 millimeters by a gap of air or other dielectric medium. A narrower gap substantially narrows the bandwidth of the antenna and increases the lowest resonant frequency. The number of tuning states, and therefore the number of shorting pins and switches, needed to cover the desired frequency spectrum is increased. Additionally, the size of the patch element and ground plane are increased to compensate for the smaller gap or spaced distance separating the patch element and ground plane.

Figure 11:
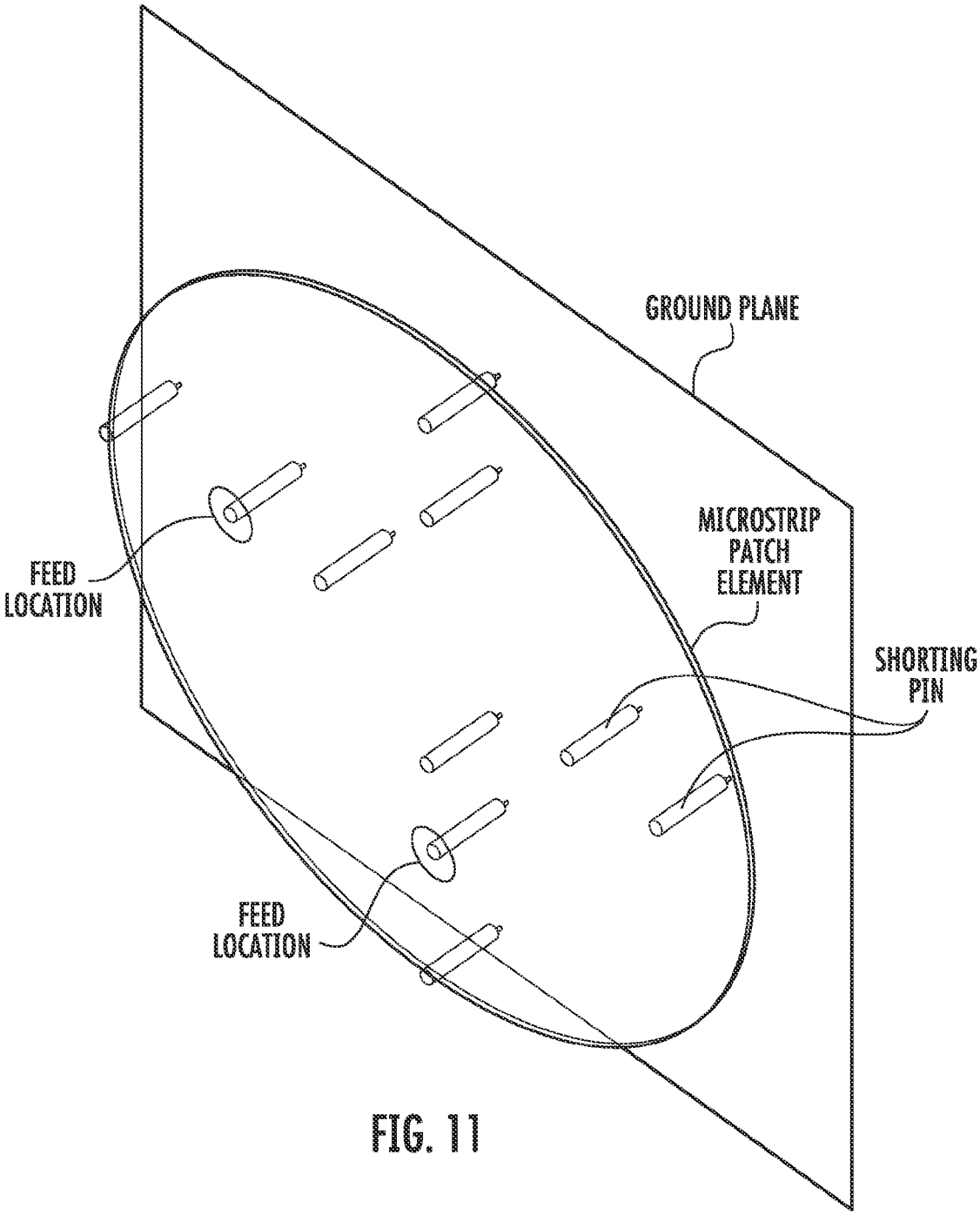
FIG. 11 is a dual polarized reconfigurable microstrip antenna with dual feed lines and four shorting pins for each polarization.

FIG. 11 illustrates an exemplary embodiment of a dual polarized reconfigurable microstrip antenna. As shown in FIG. 11, the reconfigurable microstrip antenna includes four shorting pins and associated switches in a first line and four shorting pins and associated switches in second line perpendicular to the first line. Thus, the reconfigurable microstrip antenna has 32 states including 16 resonant frequencies in a first or horizontal polarization and 16 resonant frequencies in a second or vertical polarization. The reconfigurable microstrip antenna includes two separate feeds—one feed for each polarization. The two feed locations are indicated by the two pins (second from the left, and second from the bottom) that include the circular top hat capacitors. The remaining pins control tuning. For some preferred embodiments, the impedance matching was generally improved by completely removing the top hat capacitor and directly connecting to the disc antenna element.

Continuing with the description of the example shown in FIG. 11, the ground plane of the reconfigurable microstrip antenna element is approximately 300 mm×300 mm. This reconfigurable microstrip antenna includes a circular patch element spaced apart or above the ground plane by about 25 mm. Also in this example, air is the dielectric medium between the circular patch element and ground plane. In some preferred embodiments, it was determined that the 25 mm spacing would increase resonant frequency to compensate for the longer electrical distances between the shorting pins and reflector, thus decreasing size as compared to antennas with a greater spacing between the patch element and the ground plane.

Figure 12:
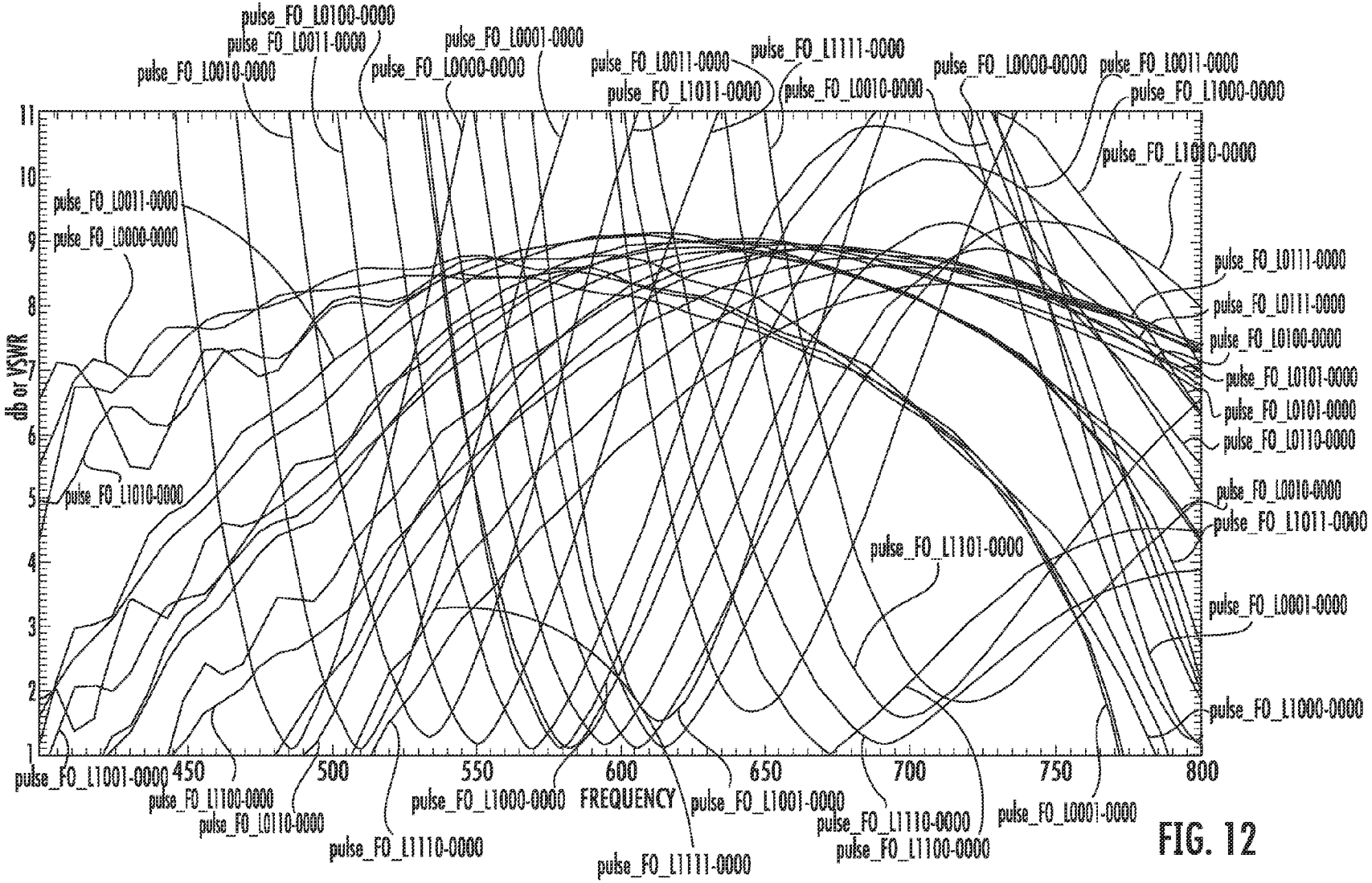
FIG. 12 is a graph of the VSWR (relative to 75 ohms) and directivity versus frequency over a bandwidth of 400 megahertz to 800 megahertz for sixteen states of one polarization of the antenna of FIG. 11.

FIG. 12 graphically illustrates VSWR relative to 75 ohms (shown by dotted lines) and directivity for the computed tuning states of the reconfigurable microstrip antenna shown in FIG. 11. In FIG. 12, the vertical axis begin at 1 (VSWR or db) and ends at 11 (VSWR or decibels), and the horizontal axis is from 400 Mhz to 800 Mhz (in 50 MHz increments). The tuning states of each polarization cover the UHF band from 470 MHz to over 698 MHz. Typical VSWR for each state less is than 2:1 relative to 75 ohm. Typical directivity (dB) for each state is between 7.5 and 9 dB.

The multiple narrow band states of the dual polarized reconfigurable microstrip antenna shown in FIG. 11 may prove advantageous in improving effective dynamic range of a receiver system because signals significantly away from the desired channel are attenuated.

Smart antenna arrays may be formed by incorporating a plurality of reconfigurable antenna elements, a selectively switched plurality of non-reconfigurable (i.e., fixed geometry) antenna elements, and/or a phased array of non-reconfigurable (i.e., fixed geometry) antenna elements. The elements may be oriented in various ways and combinations to achieve various goals. In exemplary embodiments, a smart antenna array may include fixed geometry antenna elements, such as the tapered loop antenna illustrated in an exploded view in FIG. 14. By way of further example, a smart antenna array may include a fixed geometry antenna element, such as an antenna element disclosed in U.S. Application Publication No. 2009/0146899 (published on Jun. 11, 2009) and/or U.S. Patent Application Publication No. 2009/0146900 (published on Jun. 11, 2009), the disclosures of each of these patent applications are incorporated by reference herein in their entirety.

Figure 13:
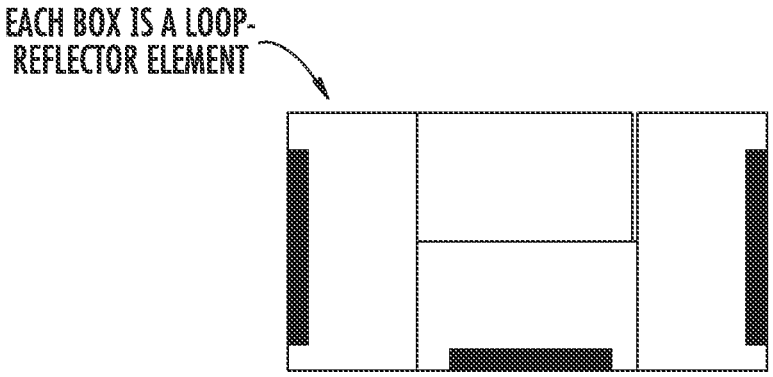
FIG. 13 is a top view of a four element switchable antenna array with the elements arranged facing four different directions.

FIG. 13 illustrates an exemplary switched directional sectoral antenna (e.g., for use as a UHF antenna, etc.) using fixed geometry antenna elements. The fixed geometry antenna elements may be any suitable antenna elements. As shown in FIG. 13, two antenna elements are placed back to back and two more antenna elements are used as "book ends" to complete an array that covers four quadrants. In this example embodiment, each of the elements has a −3 decibel beamwidth of 70 degrees. The overall size of this configuration may be about 50 cm (from left to right in FIG. 13)×25 cm (from top to bottom in FIG. 13)×25 cm (into the page in FIG. 13), which leaves some room on the top or bottom, for example, to integrate a reconfigurable VHF element.

Figure 15:
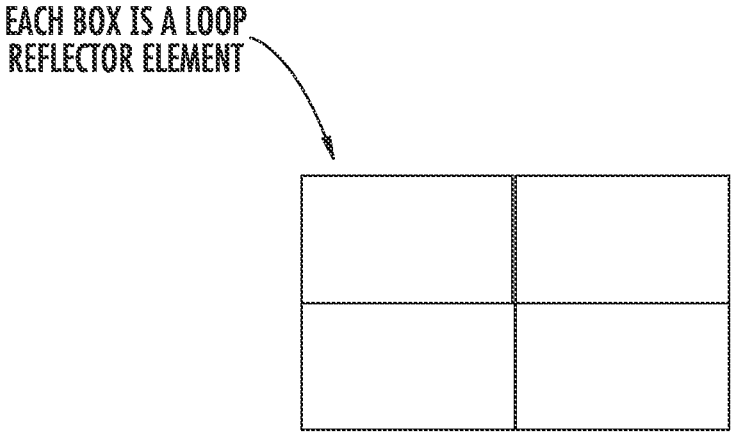
FIG. 15 is a top view of another four element switchable antenna array with the elements facing two opposing directions.
Figure 14:
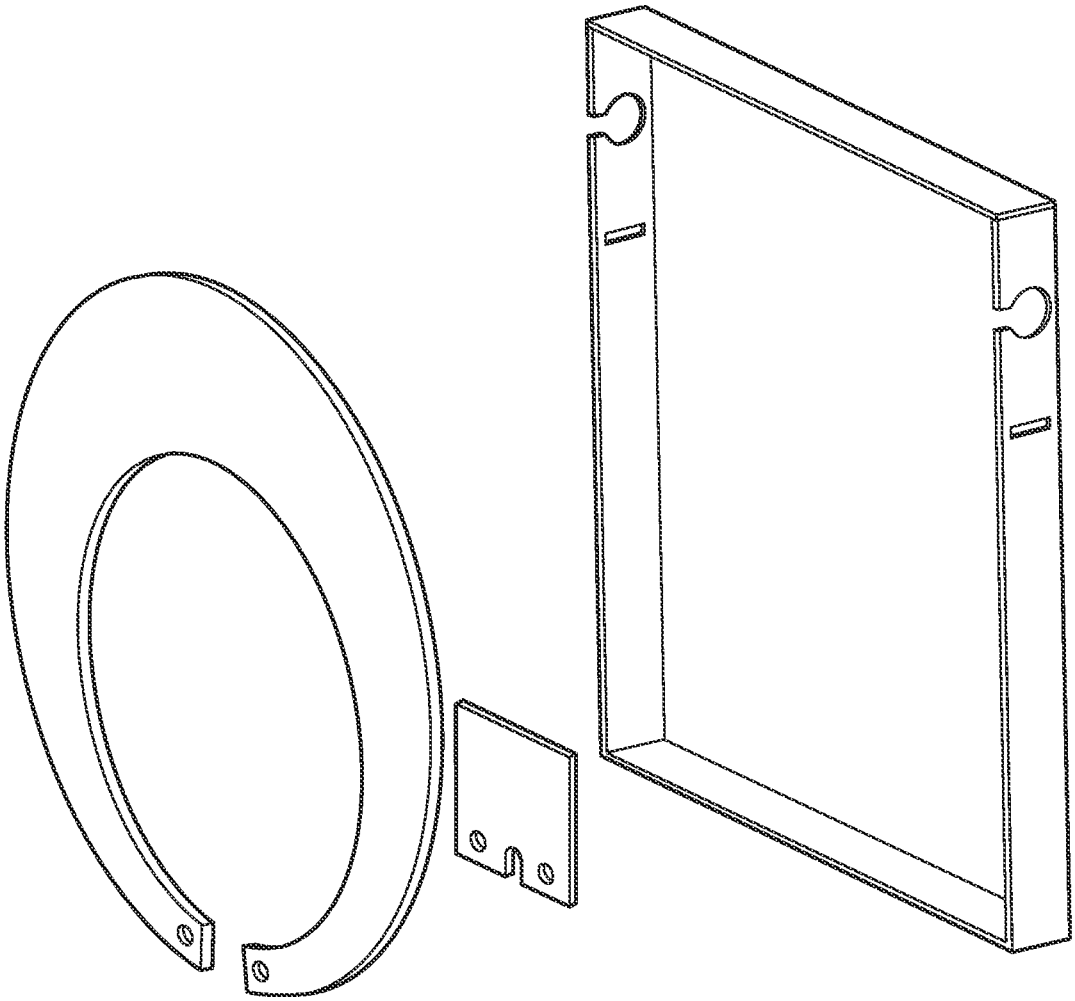
FIG. 14 is an exploded view of a tapered loop antenna element for use in an array according to the present disclosure.

FIG. 15 illustrates an exemplary bi-directional diversity or high gain antenna, which may, for example, be used as a UHF antenna. This example embodiment may provide higher gain only or primarily in two directions as compared to the antenna shown in FIG. 13. In the illustrated embodiment of FIG. 15, the antenna elements may be phased to allow higher gain in one of two directions. Alternatively, a diversity scheme can be used to simply select the antenna element with the best or strongest reception. Diversity may be as effective as beam steering indoors due to propensity for phase cancellations and multi-path in that environment. The overall size of this example embodiment may be about 50 cm (from left to right in FIG. 15)×25 cm (from top to bottom in FIG. 15)×25 cm (into the page in FIG. 15), which leaves some room on the top or bottom, for example, to integrate a reconfigurable VHF element.

In another exemplary embodiment, two reconfigurable loop/reflector elements may be positioned or integrated into a generally U-shaped structure. Each pair of loop/reflector elements may be positioned in a corresponding one of the upstanding legs of the U-shaped structure, such that the loop elements face or point in opposite directions. This may allow for selection of two different directions, provide bi-directionality, and provide switchable polarization. Plus, the space within the U-shaped structure between the upstanding legs may also provide a storage area, such as for holding letters, etc. Alternative embodiments may include other structures besides U-shaped structures, such as a structure designed with a storage area for holding a vase or plant.

Figure 16:
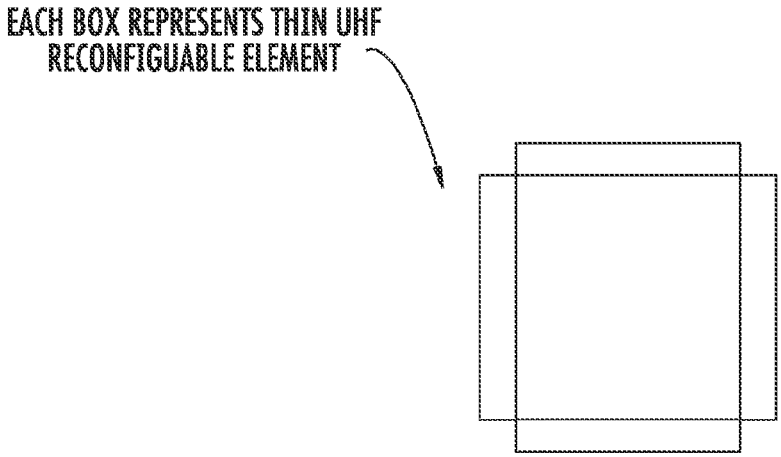
FIG. 16 is a top view of a four element antenna array including reconfigurable antenna elements arrayed to face four different directions.

FIG. 16 illustrates another exemplary embodiment of an antenna array, which may be used as a switched directional sectoral UHF antenna. In this embodiment, four reconfigurable antenna elements are configured in a cube and selectable between the four directions (right, left, top, and bottom directions in FIG. 16). The cube may be sized such that it is approximately 37 cm (from left to right in FIG. 16)×37 cm (from top to bottom in FIG. 16)×30 cm (into the page in FIG. 16). The four antenna elements are relatively thin and define an empty volume inside of the antenna box, which empty volume may be used for other purposes, such as storage, as a plant holder, etc. Alternative embodiments may include more or less than four antenna elements and/or antenna elements combined to form other open array shapes. For example, three elements may be used to form a triangle, five elements may be used form a pentagon, etc.

Another exemplary embodiment of an antenna array includes two reconfigurable antenna elements located side by side in a panel. The panel may be configured as a 300 mm×600 mm×35 mm relatively flat panel. The array may configured such that it has a gain in a range of about 9 dB to 12 dB. Phasing may be used with this array to allow beam steering. A diversity switching scheme may be also or instead be used, for example, when the antenna is used indoors. In some embodiments, a second set of reconfigurable antenna elements may be added on the opposite side of the array such that the first and second sets of reconfigurable antenna elements face in the opposite directions and cover opposite hemispheres. In such alternative embodiments in which there are first and second sets of oppositely facing pairs of antenna elements, the antenna array may be about 70 mm thick.

Figure 17A:
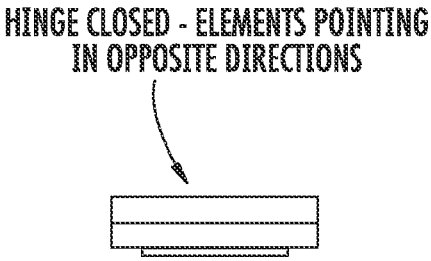
FIG. 17A is a top view and a front view of a hinged two element array including reconfigurable antenna elements shown in a closed position.
Figure 17C:
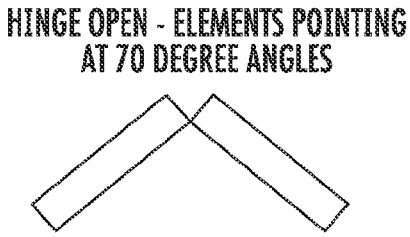
FIG. 17C is a top view of the hinged two element array of FIG. 17A shown in an open position.
Figure 17B:
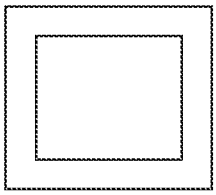
FIG. 17B is a front view of the hinged two element array shown in FIG. 17A in the closed position.
Figure 17D:
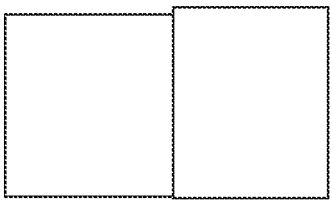
FIG. 17D is a front view of the hinged two element array shown in FIG. 17C in the open position.

FIGS. 17A, 17B, 17C, and 17D illustrate another exemplary embodiment of an array (e.g., reconfigurable UHF antenna array, etc.) in which two reconfigurable antenna elements are connected by a hinge, such as in a manner similar to a picture frame. In this example, a 909 interface may be used to control tuning and polarization of each antenna element. The 909 interface may be configured to select the antenna element with the stronger signal. In some embodiments, a sensor may be provided in the hinge for sensing when the antenna elements are flat, such that phasing rather than switching may be performed for enhanced gain. FIGS. 17A and 17B depicts the antenna elements in a closed position in which the antenna elements face or point in opposite directions and the thickness is 7 centimeters (from top to bottom in FIG. 17A) and the width is 30 centimeters (from left to right in FIG. 17B). FIGS. 17C and 17D show the antenna elements in a deployed or open position in which the beams are separated, for example, to allow reception from widely separated towers. Also when in the deployed position, the antenna elements face or point at 70 degree angles with a height of 30 centimeters (from top to bottom in FIG. 17C) and width of 50 centimeters (from left to right in FIG. 17D).

The antenna arrays discussed above may be constructed of discrete antenna modules. For example, each box in the array of FIGS. 13, 15, 16, 17A, and 17B may be a separate antenna module. For example, an array disclosed herein may include an antenna module having a housing, an input for receiving a control signal from an external television device, and an antenna element within the housing. The antenna element may be a reconfigurable antenna element or a fixed geometry (i.e., non-reconfigurable) antenna element. The module may further include a controller to receive the control signal and configure a state of the antenna in response to the control signal. The module may also include an interface for communicatively coupling the module to one or more like antenna modules. Alternatively, or additionally, some modules may not include a controller. These controller-less modules may be controlled instead by a module to which they are connected that does include a controller in a master-slave relationship. In some embodiments, the housing of an antenna module may be configured for interlocking connection to other like modules. Such configuration of the housing may include tabs and slots, snap couplings, pins, plugs, etc. This modular system allows a user to configure an array of as many or few antenna elements having as many or few orientations as the user desires. Thus, a user can customize an antenna array to suit the user's needs, desires, location, etc.

In various embodiments of the present disclosure, smart antenna systems are based on unique low-profile dual-polarized tunable microstrip elements. Some embodiments include up to two unique low-profile dual-polarized tunable microstrip elements that are connected to achieve beam or spatial diversity. Each element offers both vertical and horizontal polarization and the ability to tune across the post 2009 UHF DTV frequency bands of 174 megahertz to 216 megahertz and from 470 megahertz to 698 megahertz. The use of a tunable element is acceptable in that the CEA-909/CEA-909A Mode-A transfer provides digital channel information to the antenna. Using "tunable bandwidth" to achieve frequency agility in some embodiments allows for relatively smaller construction yet still provide higher performing antennas for DTV reception. In such embodiments, the tunable bandwidth approach also suppresses reception of interfering channels and signals from non-television sources. This is akin to having the antenna function as an automatic preselector ahead of the broadband receiver to reduce noise and make it easier for the receiver to select and receive the desired channel.

Figure 18:
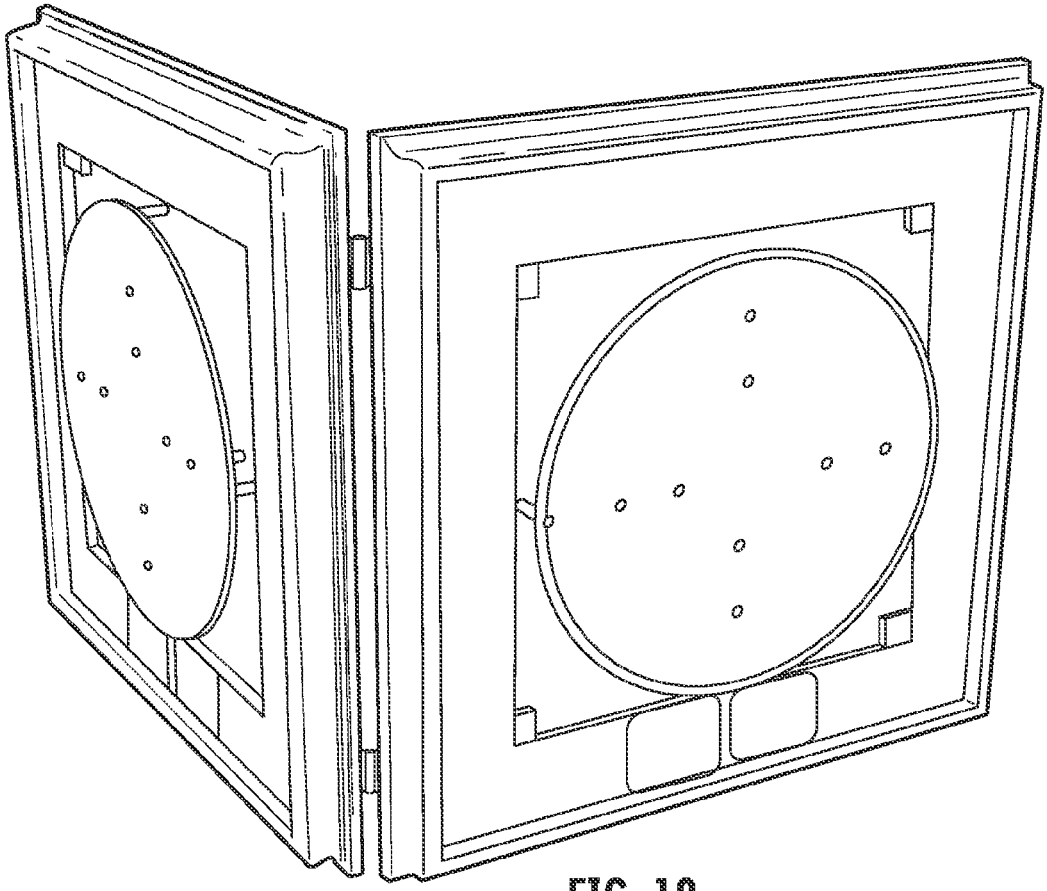
FIG. 18 illustrates an exemplary embodiment of a smart antenna system that includes a master/slave pair of low-profile dual-polarized tunable microstrip elements mounted in picture frames that are hinged on one vertical edge.

FIG. 18 illustrates an exemplary embodiment of a smart antenna system that includes a master/slave pair of low-profile dual polarized tunable microstrip elements mounted in picture frames (e.g., wooden or plastic picture frames, etc.) that are hinged on one vertical edge. Accordingly, this assembly is suitable for placement on a bookshelf or elsewhere.

Each microstrip element may include shorting pins, switches, and feeds. In the illustrated embodiment of FIG. 18, each microstrip element includes four shorting pins and associated switches in a first line and four shorting pins and associated switches in second line perpendicular to the first line. Thus, each microstrip element has 32 states including 16 resonant frequencies in a first or horizontal polarization and 16 resonant frequencies in a second or vertical polarization. Each microstrip element shown in FIG. 18 also includes two separate feeds—one feed for each polarization. In one example, the two feed locations are indicated by the two pins respectively located second from the left and second from the bottom that are connected directly to the corresponding microstrip element. Alternative embodiments may include shorting pins, switches, and feeds configured differently, such as at different locations and/or more or less than what is shown in FIG. 18.

Figure 19:
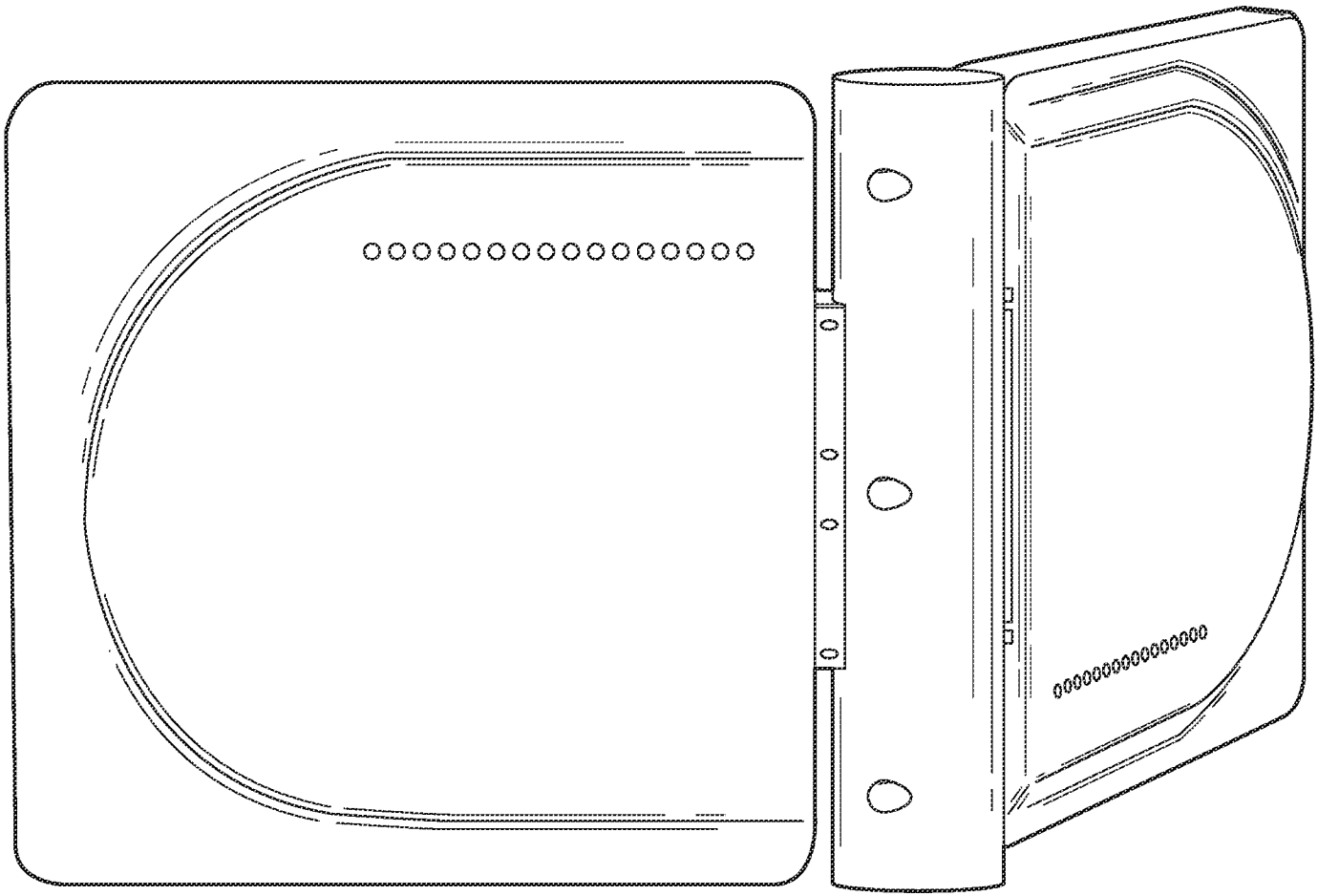
FIG. 19 illustrates an exemplary plastic shell housing for the antenna shown in FIG. 18.

FIG. 19 illustrates an exemplary plastic shell housing for the antenna shown in FIG. 18. The housing of FIG. 19 may produced by injection molding or by using a fused deposition rapid prototyping machine. Alternatively, a housing or picture frames for the antenna shown in FIG. 19 may be made from other materials besides plastic (e.g., wood, etc.) and/or via other manufacturing methods.

With continued reference to the smart antenna system shown in FIG. 18, the master element may be fitted with a CEA-909A enabled coaxial (F-connector) input/output, as well as a the standard 6-wire CEA-909 smart antenna connector to enable interface agility and backward compatibility with the older standard. A separate AC/DC power supply is not provided for the smart antenna system in this exemplary embodiment, because electrical power may be obtained or supplied via the CEA-909/909A connections. The master element also includes or contains the electronics and decoder logic for interpreting both 909 and 909A data transfers from the receiver and configure the tunable microstrip disc elements employed in both the master and slave units. Each microstrip element offers up to 16 UHF tuning states for each polarization. The tuning state is selected depending upon channel information supplied by the CEA-909/909A enabled receiver. A four way RF switch is used to select the strongest signal from among the polarization states available in each panel. This two-panel solution is capable of directing a beam in two different directions depending on orientation and hinge angle. Beam coverage for each panel is roughly 70 degrees, such that this smart antenna system's two panel configuration offers considerable flexibility. Alternative embodiments may include more than one slave element and/or one or more elements configured differently than a dual-polarization tunable microstrip element having 16 UHF tuning states for each polarization. By way of example, other embodiments may include up to three slave elements to enable coverage of additional directions, or to enable enhanced reception through spatial diversity. Additionally, a phasing system for gain enhancement may be implemented in other embodiments.

In addition to logic and decoding circuitry, the master element of the embodiment illustrated in FIG. 18 is also fitted with a high quality low-noise pre-amplifier to boost signal levels without introducing Intermodulation Distortion (IMD). The pre-amplifier has a gain of 17 dB, a noise figure of approximately 2 dB, and a Third-Order Intercept point of approximately +28 dBm (100 kHz tone spacing). The pre-amplifier circuit may be integrated into the master panel as a daughter board. Alternatively, an amplifier may be integrated on the same board as the master element. Gain settings sent via CEA-909/909A signals are used to configure an attenuator ahead of the pre-amplifier to help prevent overloading the gain stage. The amplifier is followed by an additional attenuator that when enabled can reduce signals by 6 or 12 dB to help prevent receiver overload. VHF reception is enabled by connecting the reflector/backplanes of the UHF elements into a broad band plate dipole configuration. Some embodiments may also be configured to allow for connection of an external low-band VHF element.

With continued reference to the exemplary embodiment shown in FIG. 18, the smart antenna system was configured such that it was in full compliance with the CEA-909A single wire control interface standard. The smart antenna system was also operable across the Post 2009 DTV frequency bands of 174 megahertz to 216 megahertz and from 470 megahertz to 698 megahertz, and provided performance equal or better than a tuned rabbit ear antenna (approximately 0 dBi) on VHF bands. The smart antenna system was also capable of fitting in a form factor smaller than 20 in×10 in×12 in or equivalently 50.8 cm×25.4 cm×30.5 cm. Alternative embodiments may include a smart antenna system configured differently such as with a smaller or larger size.

Figure 20:
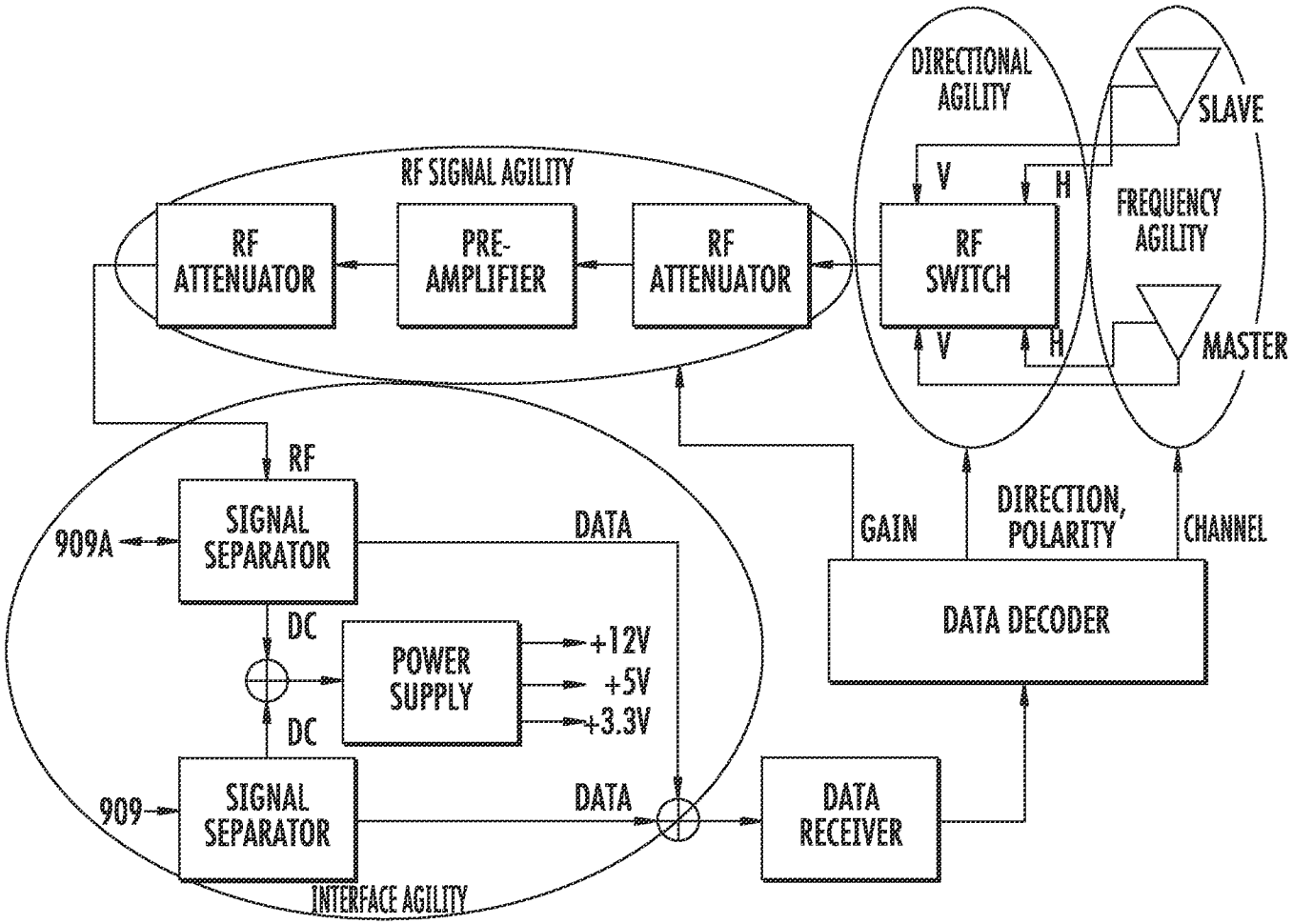
FIG. 20 is a block diagram illustrating functional elements of an exemplary embodiment of a smart antenna system.

FIG. 20 is a block diagram of functional elements of an exemplary embodiment of a smart antenna system. In this example, the smart antenna system is closely tied to the CEA-909A interface specification. Because this 'A' revision of the CEA-909 specification added a "coax only" interface solution, the F connector data interface is referred to in this example as '909A', and the modular jack data interface shall be referred to as the '909' interface. The 909A interface includes power, data, and RF signal, while the 909 interface refers only to power and data. For the 909 interface, the use of the F-connector for the separate RF signal path is assumed.

Descriptions for terminology used in FIG. 20 will now be provided. Interface agility is defined as two different physical interfaces between the smart antenna system and the TV receiver or set-top box. These are the 909 modular data interface, utilizing a separate F-connector for the RF signal interface, and the 909A interface which combines power, data and RF signal onto the F-connector, circumventing the modular jack. RF signal agility is defined as the ability to provide four combinations of RF signal path gain by utilizing a preamplifier and two attenuators. The intent is to avoid overload compression and the corresponding cross-modulation and distortion for both the preamplifier component and the TV tuner or set-top box. Directional agility is defined as the ability to provide spatial diversity. For the purposes of this example in FIG. 20, two separate smart antenna panels provide the directional agility. A 'MASTER' panel contains the 909 and 909A interfaces and the smart antenna decoding and control circuitry. An additional 'SLAVE' panel provides directional diversity, while reducing duplication cost and complexity. Both the MASTER and the SLAVE panel provide a horizontal and a vertical polarization feed. The physical separation of the MASTER and SLAVE panels also allows the additional electrical length for supporting VHF reception. Frequency agility is defined as the ability to tune the smart antenna elements to better match COI (channel-of-interest) wavelength and exclude energy other than the COI. Excluding this unwanted spectrum, as well as the smart antenna panel directionality, are primary attempts to maximize gain while avoiding RF signal compression.

In additional embodiments, the electrical interface of the SLAVE panel may be reduced to one ribbon cable and one coax cable. By including a polarization switch on the SLAVE panel, the horizontal and vertical feeds could be multiplexed prior to exiting the SLAVE panel. This would eliminate one coax cable and its connector. This would also allow the two additional 4PST switch inputs to be used to connect 2 additional SLAVE panels, providing additional directional agility. Ultimately, a data-over-signal approach similar to 909A would allow for elimination of the ribbon cable altogether.

Also, the SLAVE panel coax interface for connecting to the MASTER panel may be replaced by a polar connector (e.g., BNC connector, etc.) in some embodiments. It would be generally preferred to have different something other than the standard F connector to avoid configuration confusion.

Figure 37:
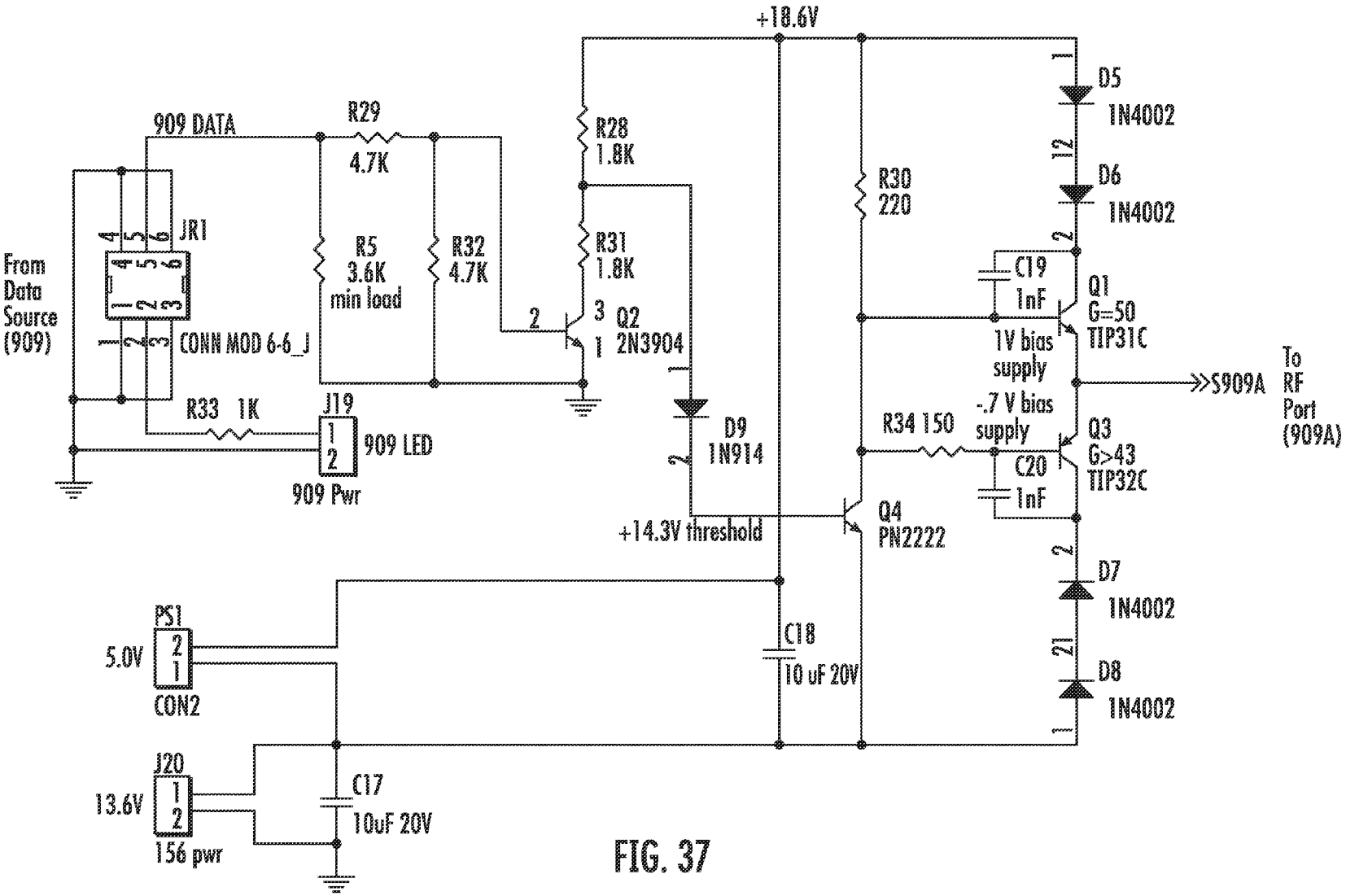
FIG. 37 is a circuit diagram illustrating a 909 to 909A converter test fixture.
Figure 38:
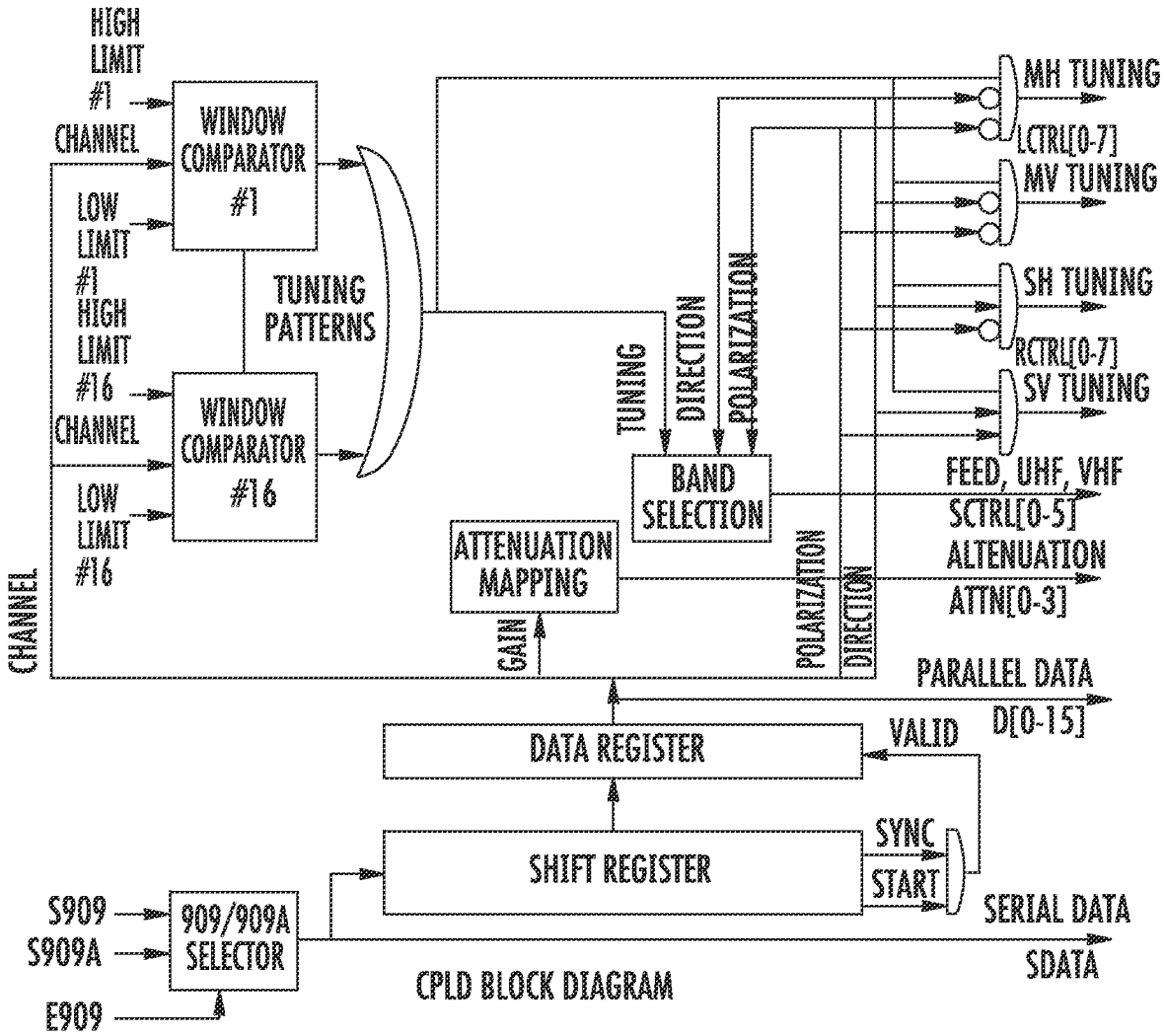
FIG. 38 is a block diagram illustrating an exemplary complex programmable logic device that may be used with a smart antenna system.

FIGS. 21 through 38 are exemplary circuit diagrams or schematics which may be used in an exemplary smart antennas system including MASTER/SLAVE panels, such as in the exemplary embodiment of a smart antenna system shown in FIG. 18. More specifically, FIGS. 21 through 32 are exemplary circuit diagrams or schematics for a smart antenna MASTER panel. FIGS. 33 through 36 are exemplary circuit diagrams or schematics for a smart antenna SLAVE panel. FIG. 37 is a circuit diagram illustrating a 909 to 909A converter test fixture. FIG. 38 is a block diagram illustrating an exemplary complex programmable logic device. It should be noted, however, that the circuit diagrams and schematics shown in FIGS. 21 through 38 are exemplary only, as other circuits and/or components might be used, for example, with other embodiments disclosed herein (e.g., the smart antenna system shown in FIG. 18).

Figure 21:
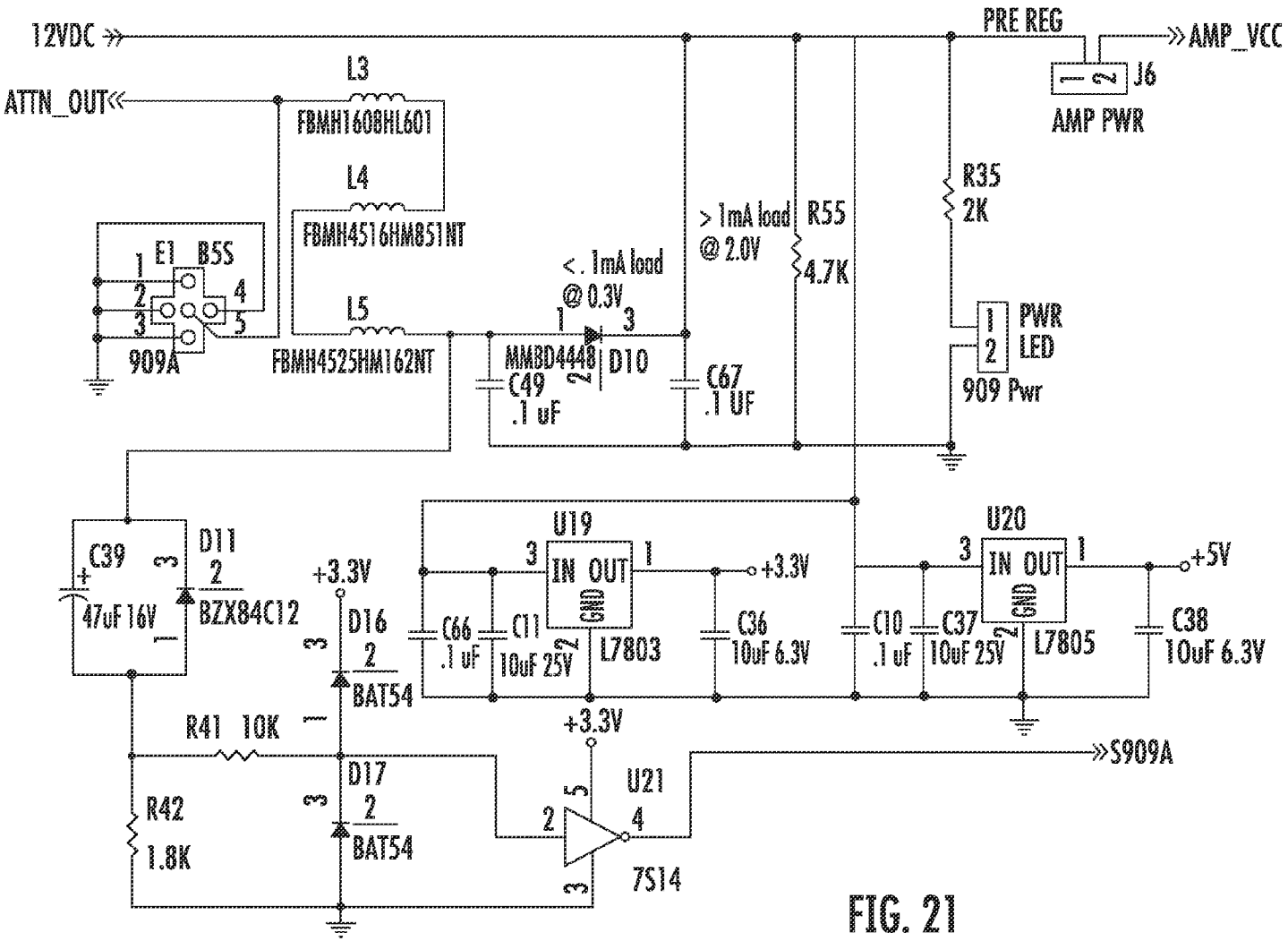
FIG. 21 is a circuit diagram illustrating an exemplary 909A signal conditioning interface that may be used for connecting a TV receiver or a set-top box to a smart antenna via an F-connector.
Figure 22:
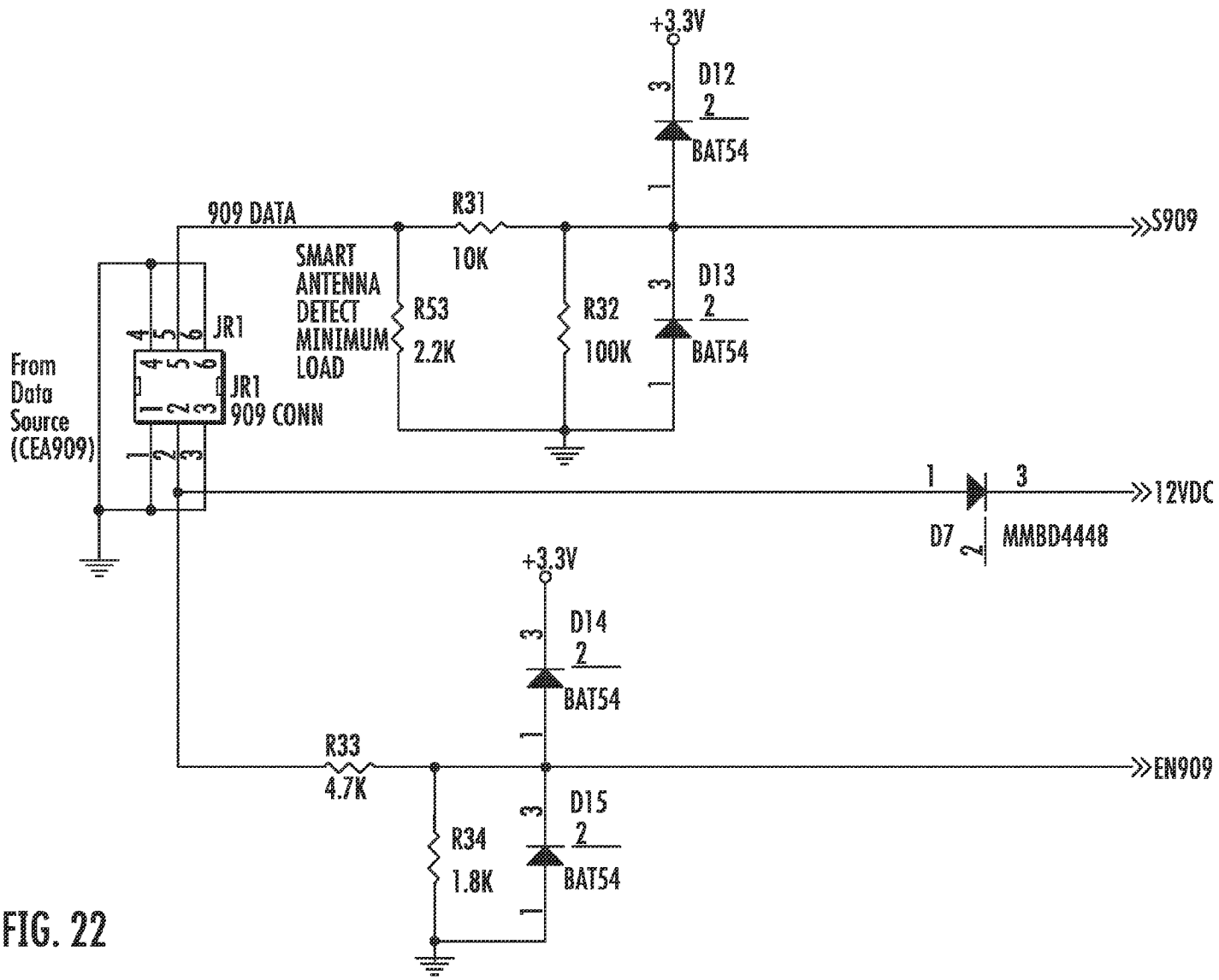
FIG. 22 is a circuit diagram illustrating an exemplary 909 signal conditioning interface that may be used with a smart antenna.

A description will now be provided of the functions of a smart antenna MASTER panel configured in accordance with the exemplary circuits or schematics shown in FIGS. 21 through 32. FIG. 21 is a circuit diagram illustrating an exemplary 909A signal conditioning interface that may be used for connecting a TV receiver or a set-top box to a smart antenna via an F-connector. The coil set L3 through L5 separate the smart antenna RF signal output from the DC and 909A data signals if present. Capacitor C49 locks down the RF characteristics such that any RF signal perturbation is at least constant. Diode D10 performs a wired-OR function for the DC power with that from the 909 signal conditioning interface (FIG. 22). The linear regulators U19 and U20 provide +5VDC and +3.3VDC for the digital portions of the smart antenna. C39 AC couples the 909A data signal, which is scaled and current limited into a surge clamp consisting of D16 and D17. U21 is a Schmitt hysteresis inverter which eliminates or reduces signal chatter about the digital signaling threshold. The 909A device identification is provided by R55 and D10. D10 limits the current load to below 0.1 mA at 0.3VDC since forward conduction conditions are not met. R55 along with the power LED R35/J23 and preamplifier provides a greater than 1 mA load @ 2.0VDC. During power-up, these two conditions identify the smart antenna from a passive device, meaning that the 12VDC power may be safely applied. The portal at J6 provides a measurement point for the preamplifier power supply current and is normally shorted.

FIG. 22 is a circuit diagram illustrating an exemplary 909 signal conditioning interface. The modular jack JR1 provides both the 909 data stream and DC power. The data signal is scaled from 5V to the 3.3V, current limited and clamped for transient safety. R53 provides a load sufficient to signal a valid 909 device to the TV receiver or set-top box. DC power is wire ORed using D7 for isolation. Additionally, the presence of DC power indicates the 909 interface is active. The 909 interface takes precedence over the 909A interface, should both be present. This 909 activity indicator is current limited, scaled and clamped as well.

Figure 23:
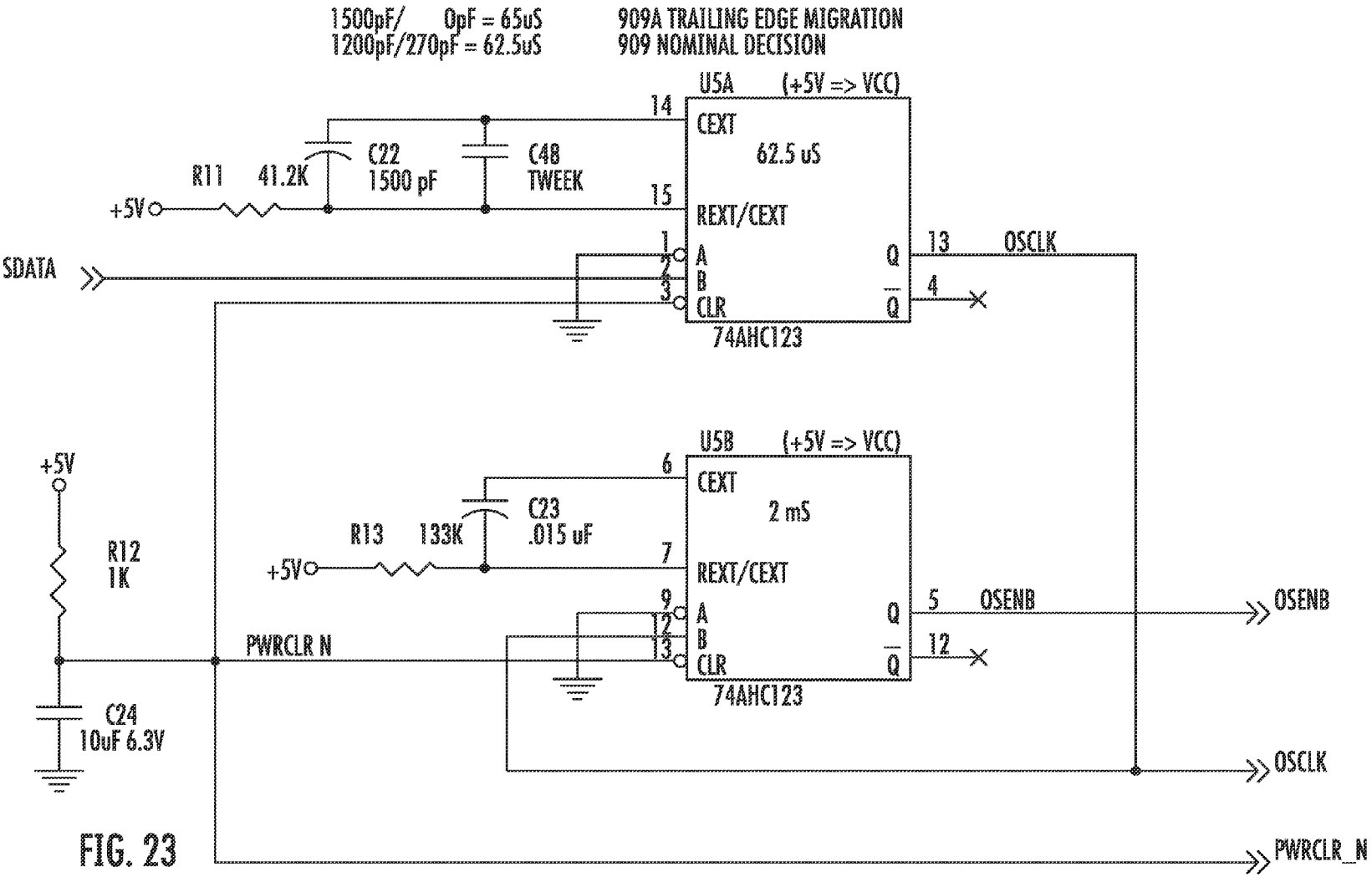
FIG. 23 is a circuit diagram illustrating an exemplary control interface that includes one-shot multi-vibrator timing circuits that may be used with a smart antenna.
Figure 24A:
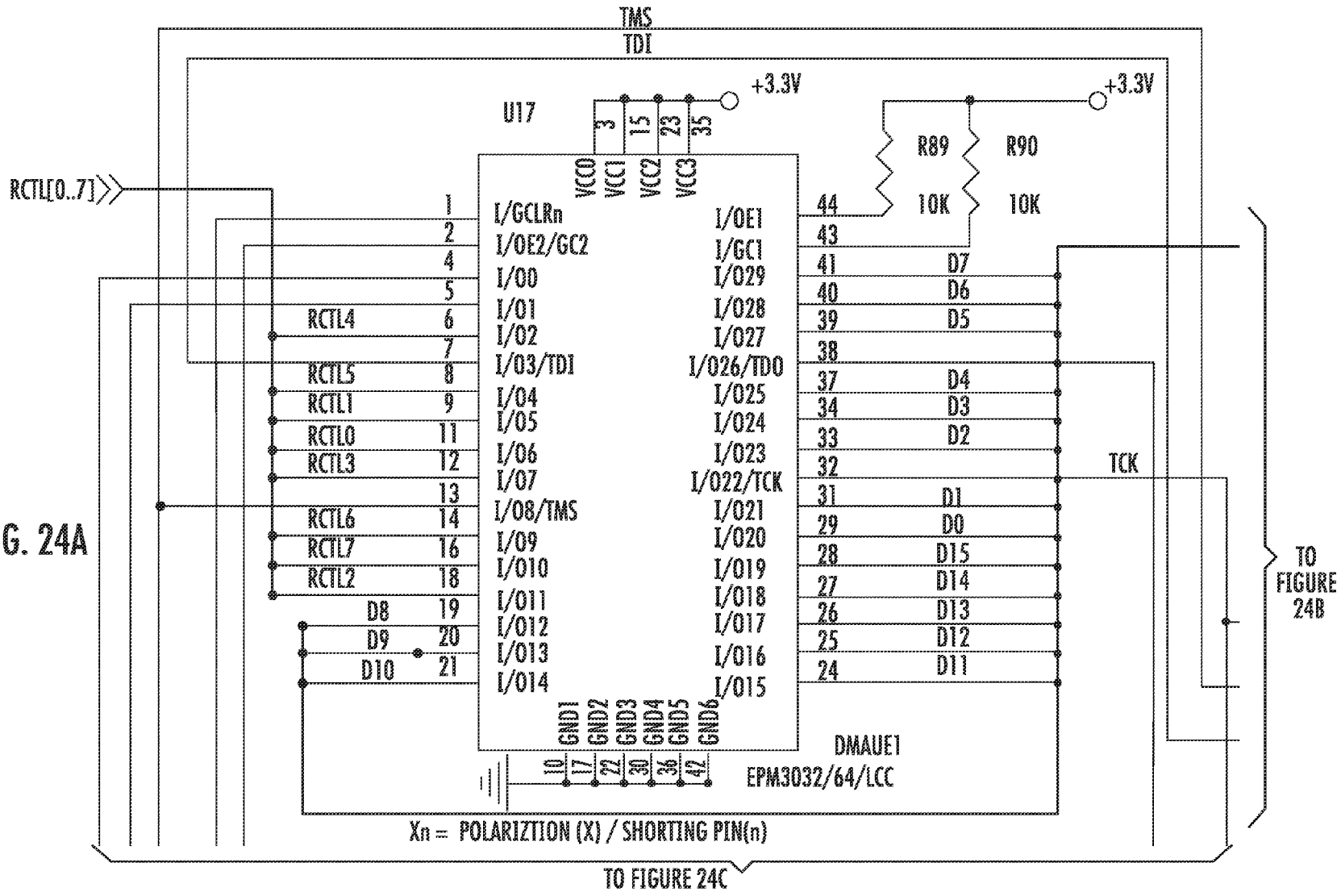
FIG. 24 is a circuit diagram illustrating an exemplary complex programmable logic device data receiver and control mapping which implements a received data pattern, and which may be used with a smart antenna.
Figure 24B:
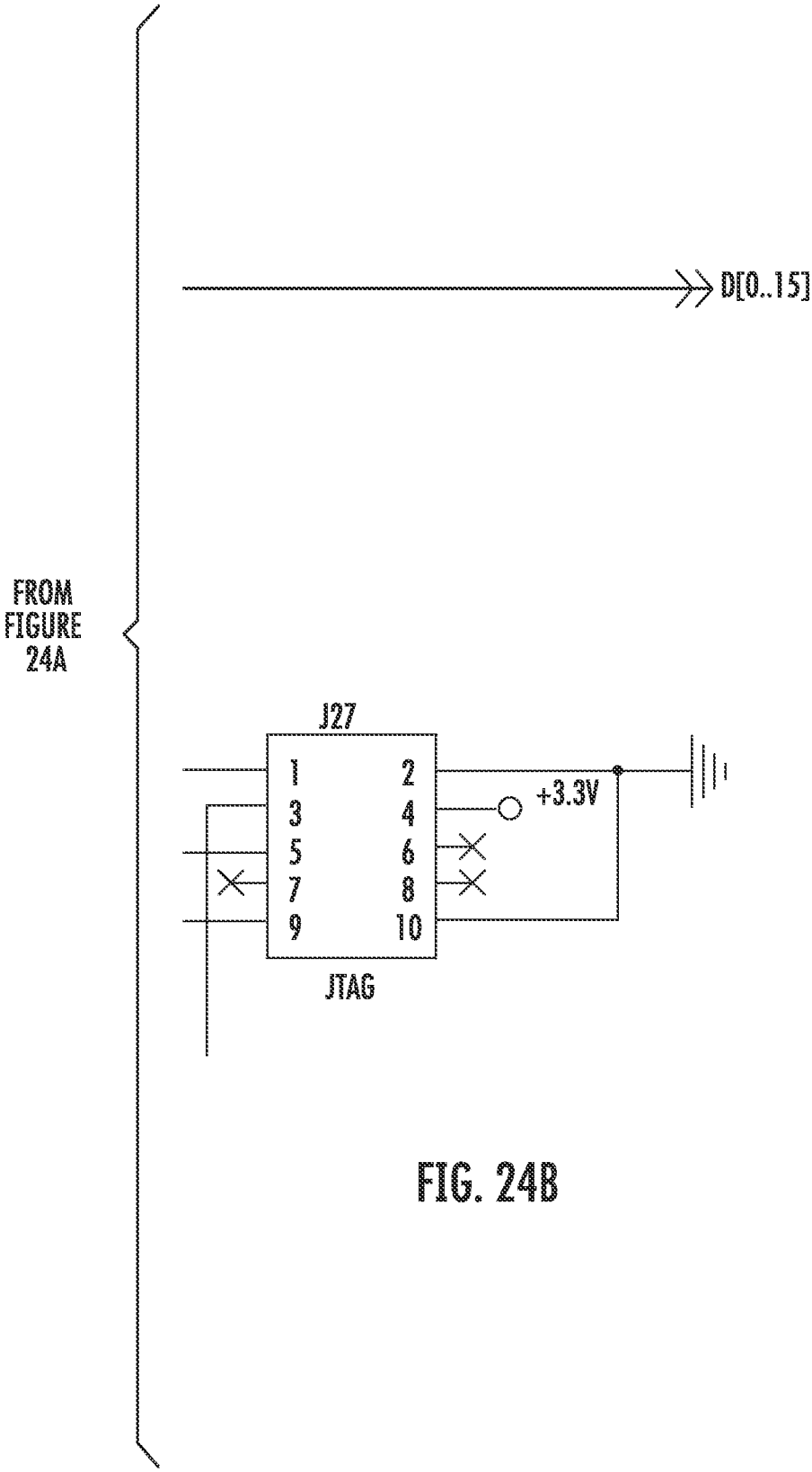
Figure 24C:
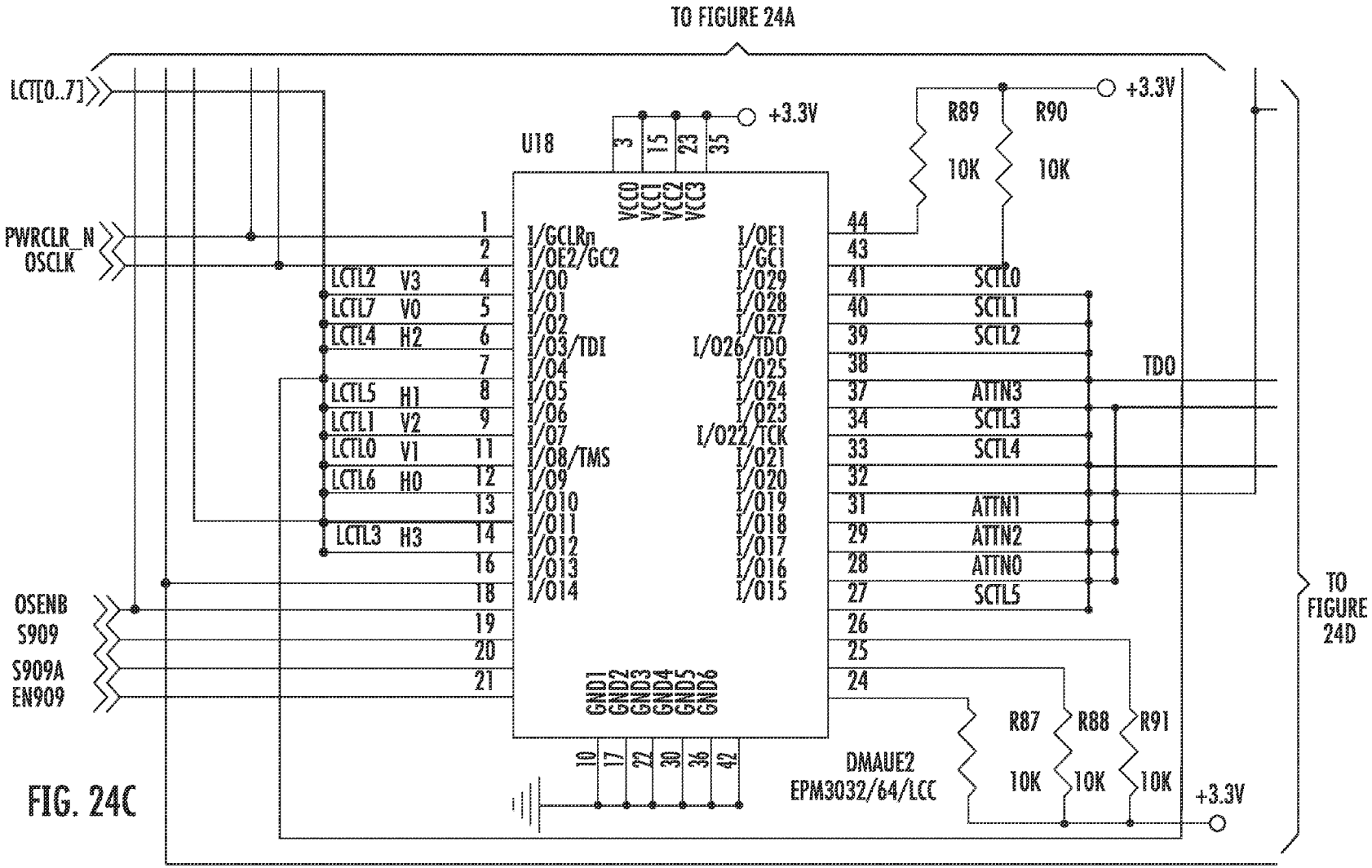
Figure 24D:
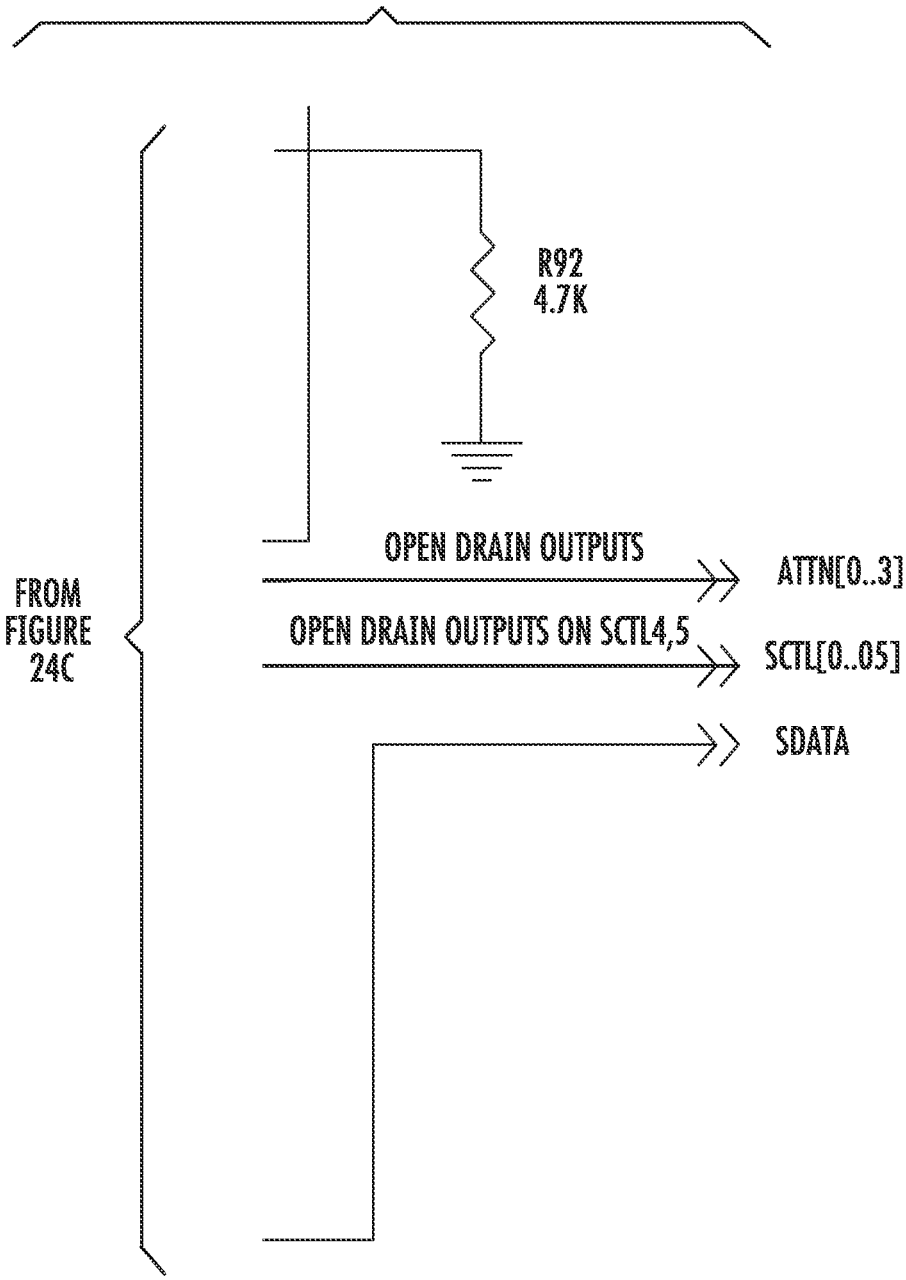

FIG. 23 is a circuit diagram illustrating an exemplary control interface that includes one-shot multi-vibrator timing circuits. U5A provides the timing for the 1/0 pulse differentiation for decoding the 909/909A data stream. This value is nominally 62.5uS. A data pulse greater than this duration is decoded as a ONE (1), while a pulse less than this duration is decoded as a ZERO (0). U5B provides the timing for the end of message detection. After 2 mS of inactivity, the message is considered complete and the date receiver is reset for the next message. Note that received data is validated when having both a SYNC bit and a START bit. Upon validation, this data is stored in a separate data register which is not reset with the data receiver. An RC time constant composed of R12 and C24 provides power up initialization for the timing and control functions.

FIG. 24 is a circuit diagram illustrating an exemplary complex programmable logic device (CPLD) data receiver and control mapping which implements a received data pattern. U17 and U18 are both electrically re-programmable components. J27 is a JTAG programming port primarily to allow for incircuit production testing and programming access.

Figure 25:
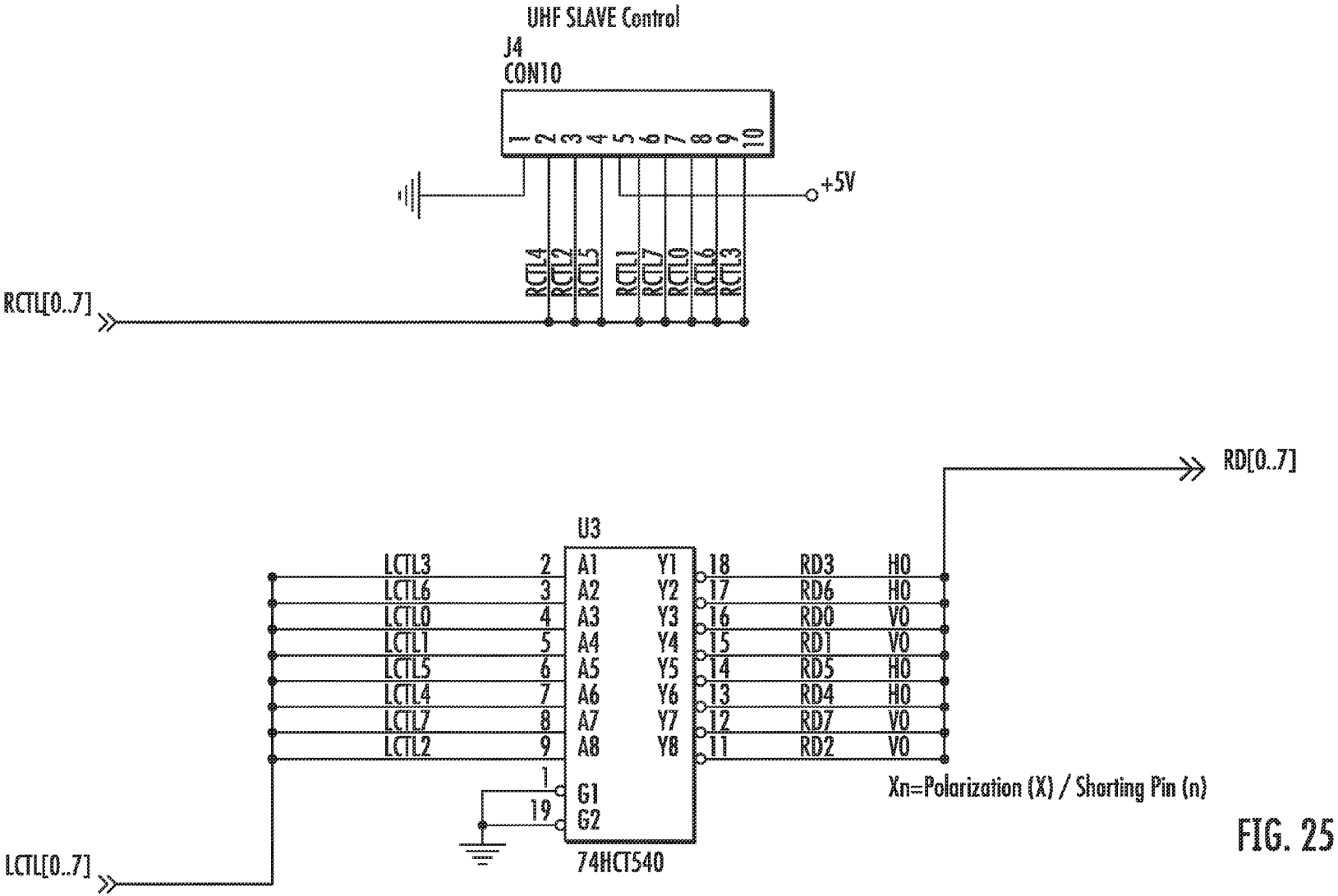
FIG. 25 is a circuit diagram illustrating an exemplary master relay drive and slave remote control port that may be used with a smart antenna.

FIG. 25 is a circuit diagram illustrating an exemplary master relay drive and slave remote control port. U3 converts the CPLD 3.3V signals to 5V signals capable of driving the MASTER tuning relays. J4 connects to the SLAVE panel and provides signals to tune that panel.

Figure 26:
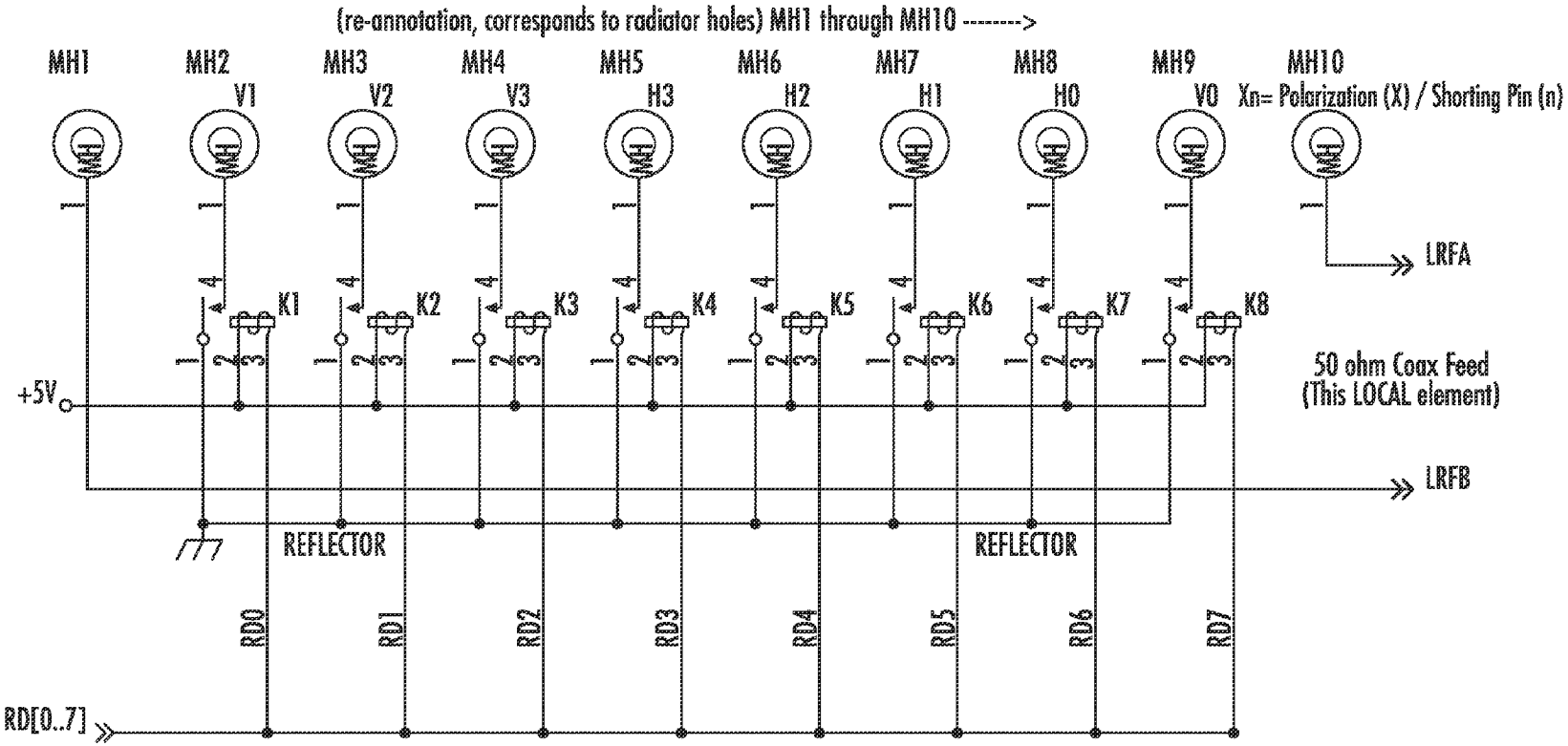
FIG. 26 is a circuit diagram illustrating exemplary master antenna element tuning components that may be used with a smart antenna.

FIG. 26 is a circuit diagram illustrating exemplary master antenna element tuning components. A smart antenna panel may be tuned by activating shorting paths in the elements to change the electrical length. Relays K1 through K8 provide the shorting function.

Figure 27:
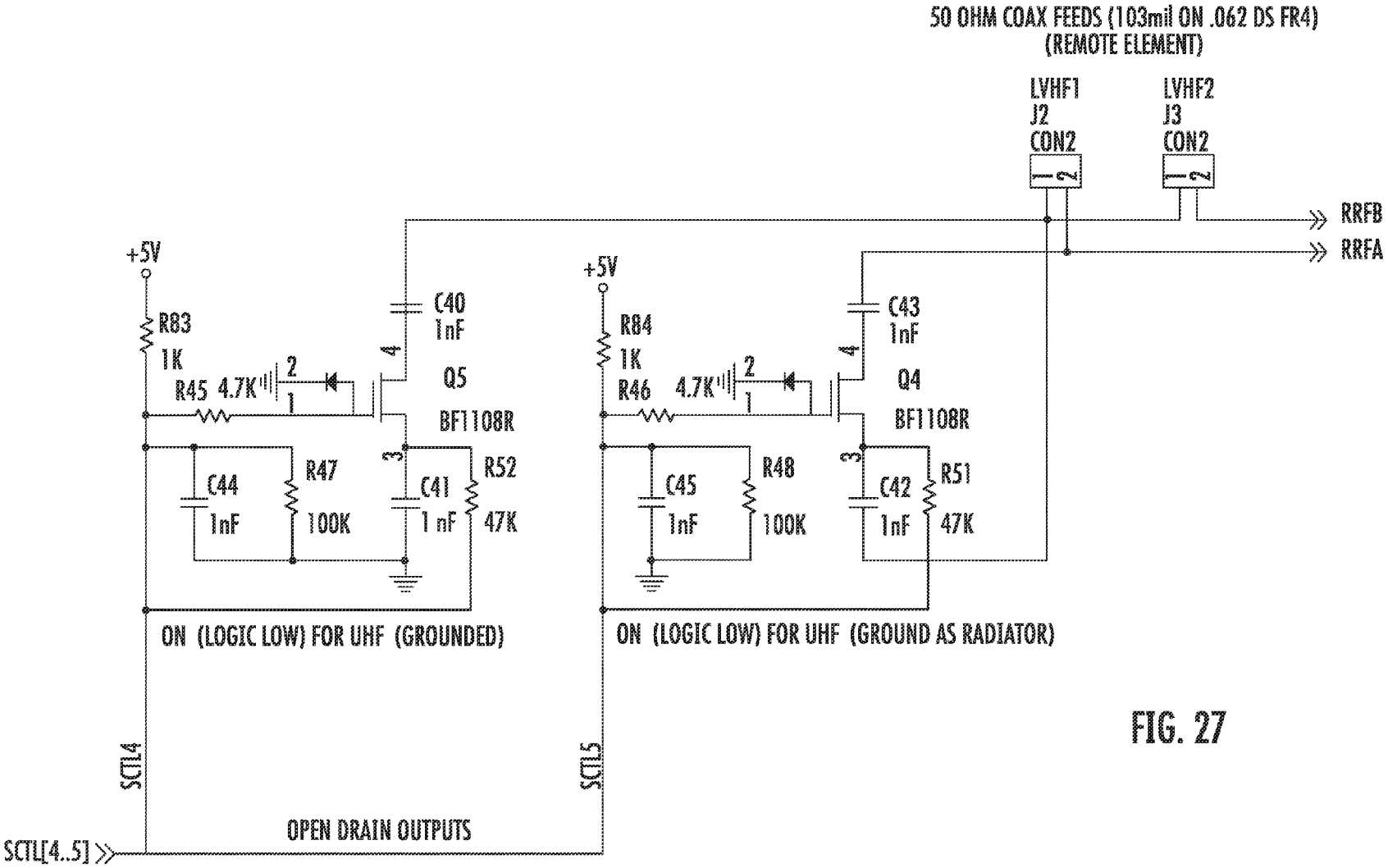
FIG. 27 is a circuit diagram illustrating exemplary UHF/VHF switches that may be used with a smart antenna.

FIG. 27 is a circuit diagram illustrating exemplary UHF/VHF switches. Q5 floats the SLAVE panel ground to "float" the SLAVE reflector in VHF mode. Q4 commits the "floating" reflector for use as one side of a large dipole antenna in VHF mode. For UHF mode, the SLAVE acts as another UHF element with the reflector grounded and the radiator connected as an RF feed. J2 and J3 are the connection points for the SLAVE horizontal and vertical feeds, respectively. The additional components about Q4 and Q5 are operable for providing a switching bias and to isolate that bias from the RF signal paths.

Figure 28:
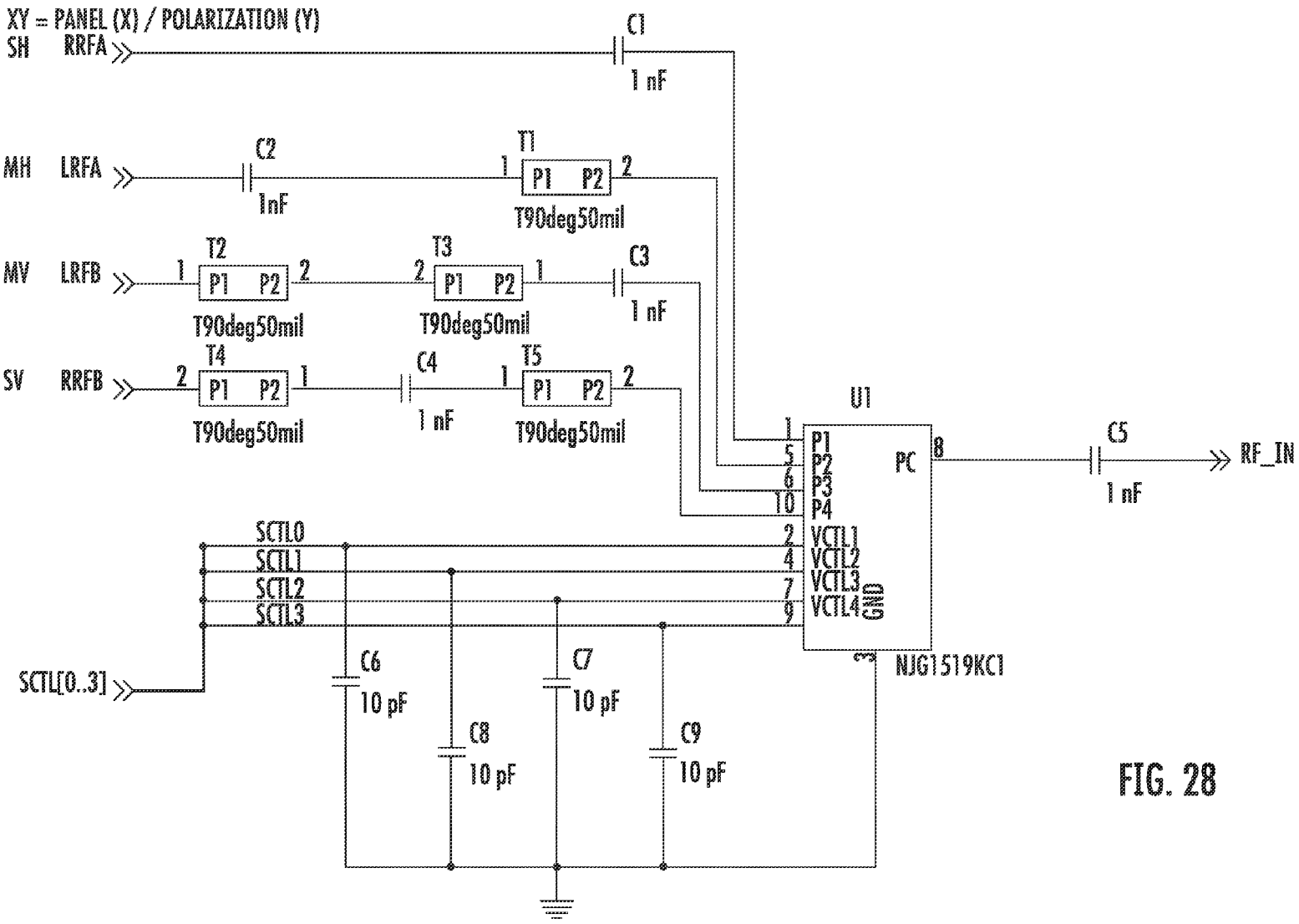
FIG. 28 is a circuit diagram illustrating an exemplary master/slave and polarization selector switch that may be used with a smart antenna.

FIG. 28 is a circuit diagram illustrating an exemplary master/slave and polarization selector switch. U1 is a 4PST switch which selects between the MASTER and the SLAVE panel, and each panel's horizontal and vertical feeds. Capacitors are used to isolate the switching bias from the RF signal paths. The transformers T1 through T5 are operable for providing smooth impedance transitions on the antenna printed circuit board.

Figure 29:
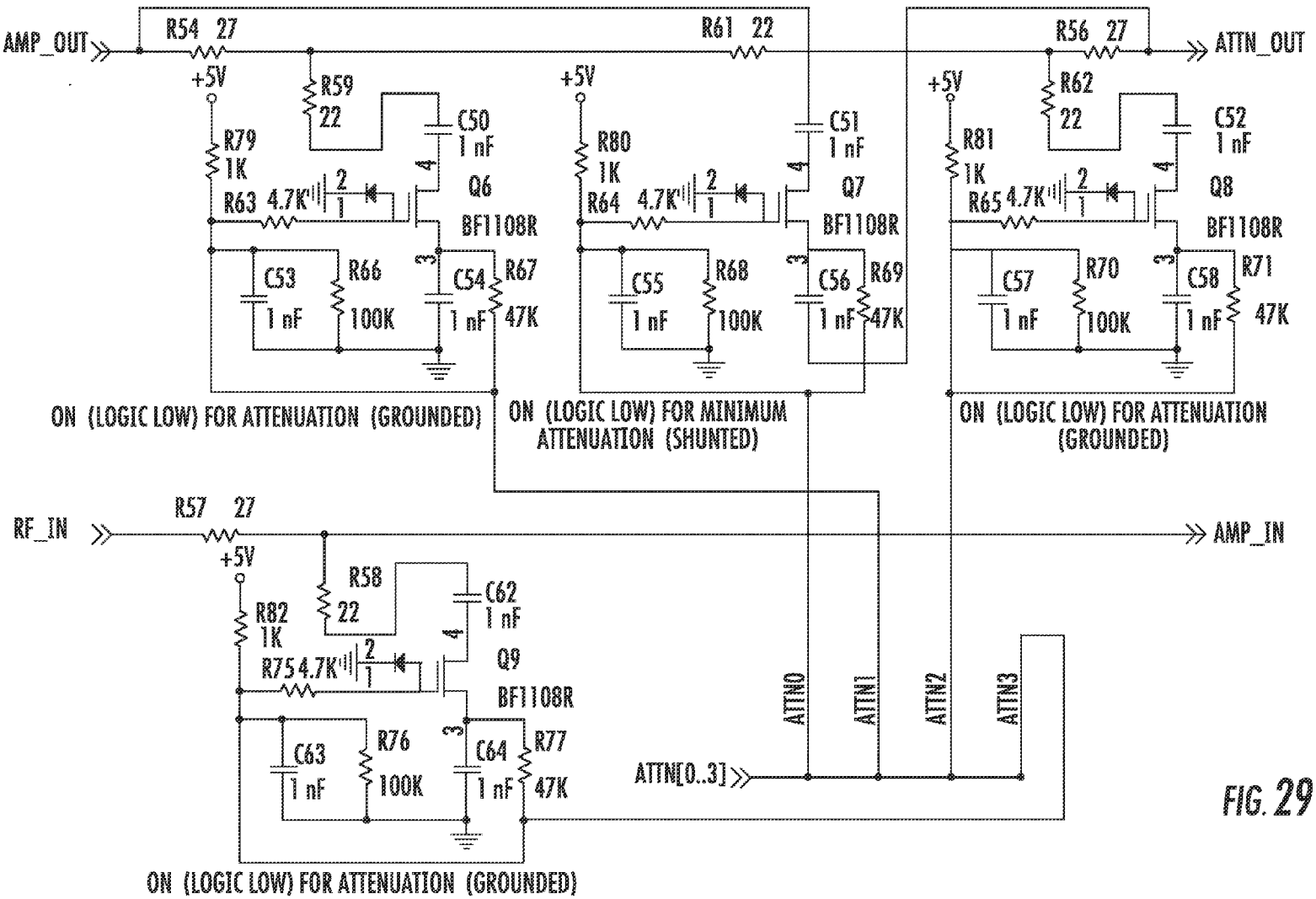
FIG. 29 is a circuit diagram illustrating exemplary RF attenuators that may be used with a smart antenna.

FIG. 29 is a circuit diagram illustrating exemplary RF attenuators that may be used to mitigate overload conditions in the preamplifier and the TV receiver or set-top box. Q9 applies a voltage divider to the preamplifier input. Q6 and Q7 apply a voltage divider to the TV receiver or set-top box signal. Q7 bypasses this attenuator for minimum or reduced noise figure and maximum or increased gain.

Figure 30:
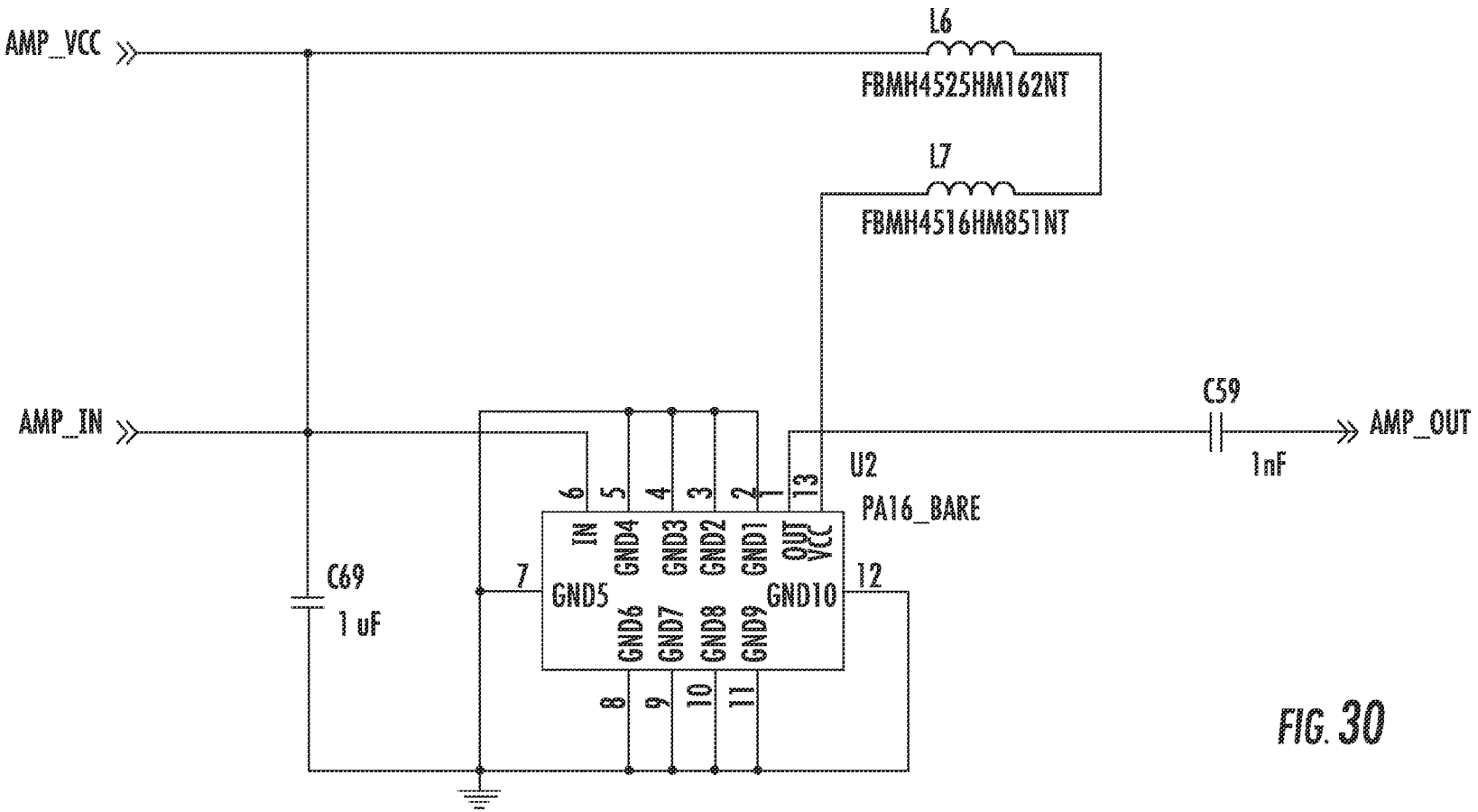
FIG. 30 is a circuit diagram illustrating an exemplary RF pre-amplifier that may be used with a smart antenna.

FIG. 30 is a circuit diagram illustrating an exemplary RF pre-amplifier. L6 and L7 isolate the DC and RF signal path, while C69 locks down any remaining leakage.

Figure 31:
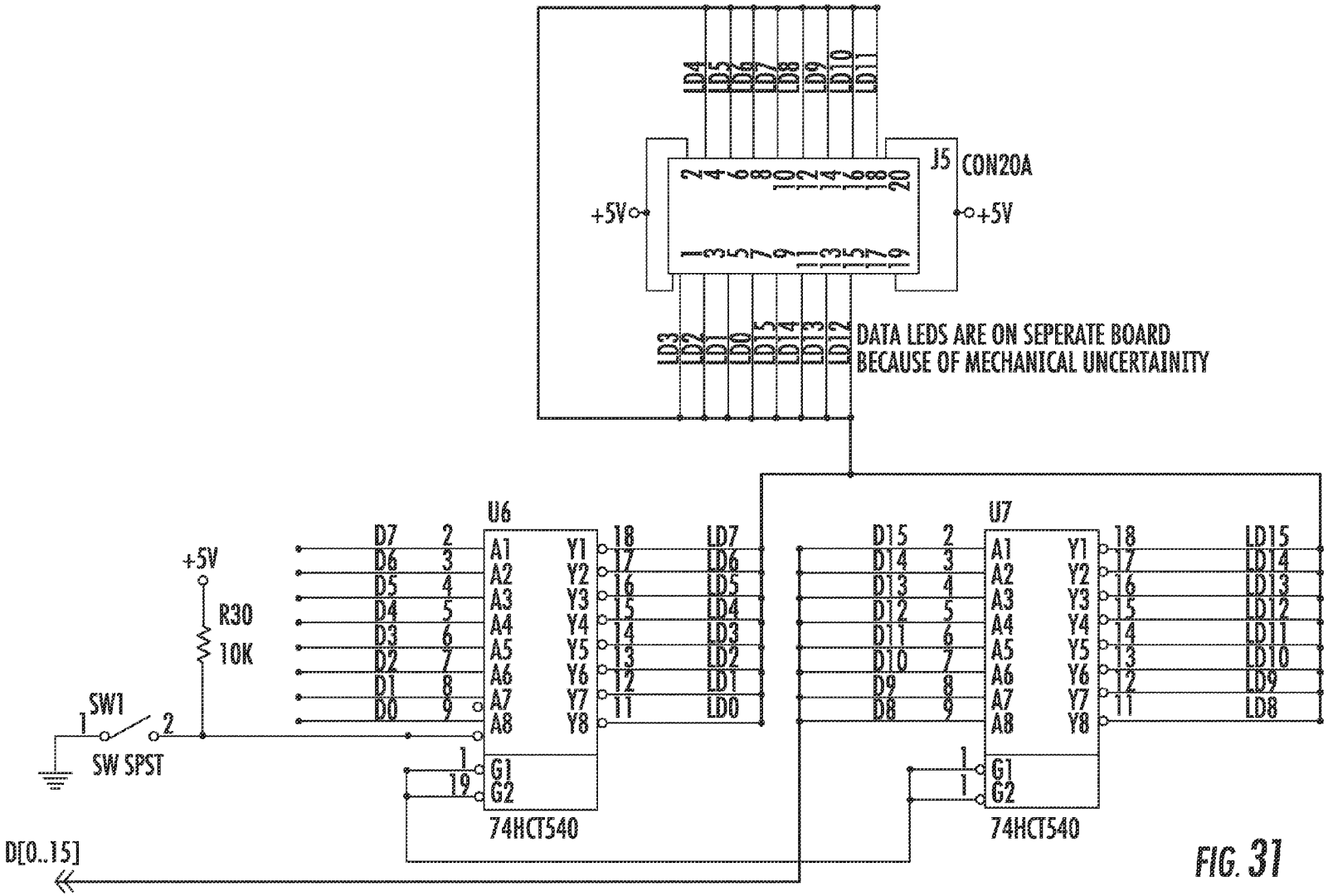
FIG. 31 is a circuit diagram illustrating an exemplary LED light-bar display driver that may be used with a smart antenna.

FIG. 31 is a circuit diagram illustrating an exemplary LED light-bar display driver. U6 and U7 provide the drive current to light an external LED light-bar display. J5 provides the connection to this display.

Figure 32:
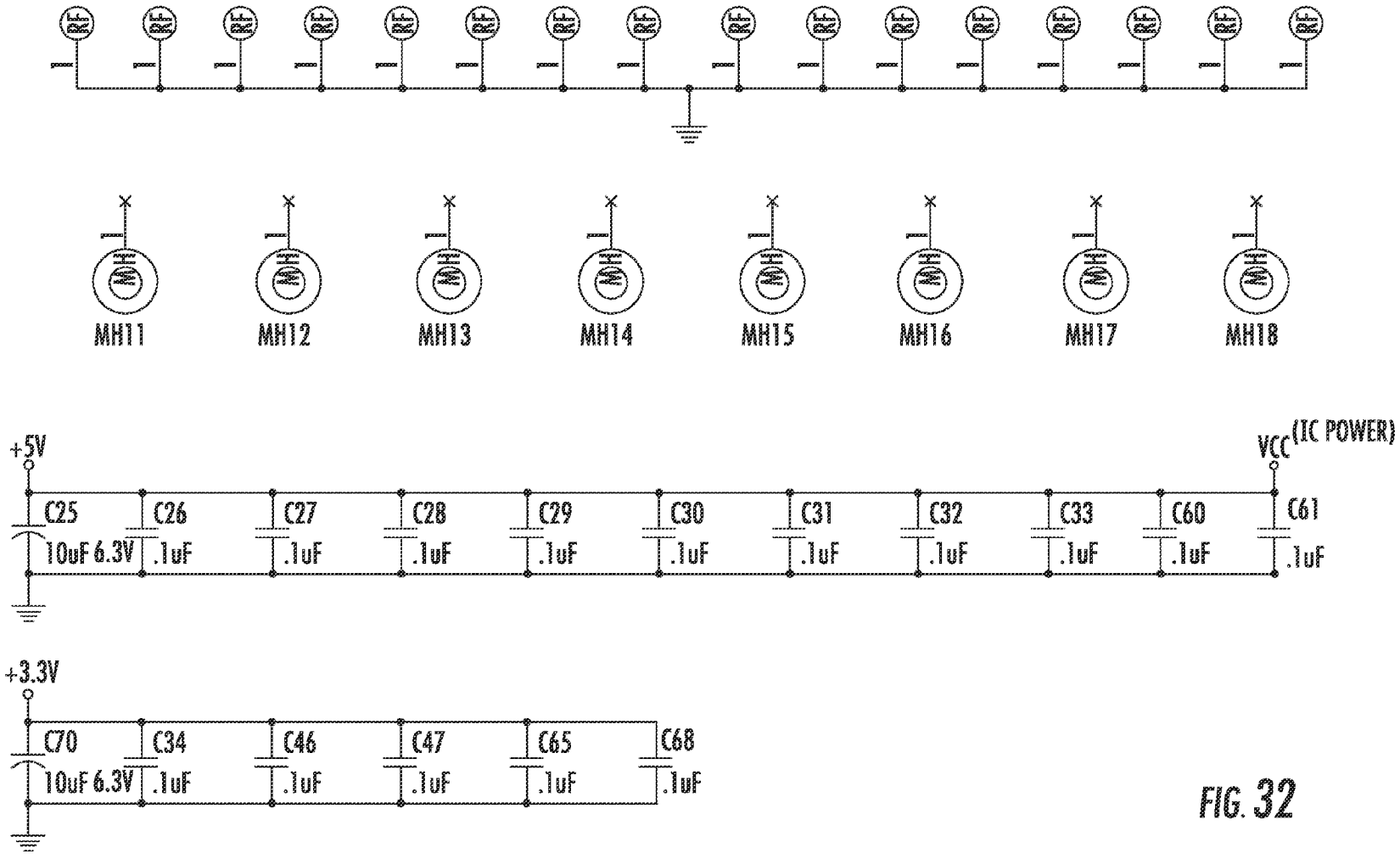
FIG. 32 is a circuit diagram illustrating exemplary decoupling logistics that may be used with a smart antenna, where the capacitors help dissipate noise from the active components of the master panel.

FIG. 32 is a circuit diagram illustrating exemplary decoupling logistics. The capacitors dissipate noise from the active components on the MASTER panel. RF vias used to tie together the printed circuit board top and bottom ground planes are accounted for here. Eight additional, electrically isolated mounting holes are also included.

Figure 33:
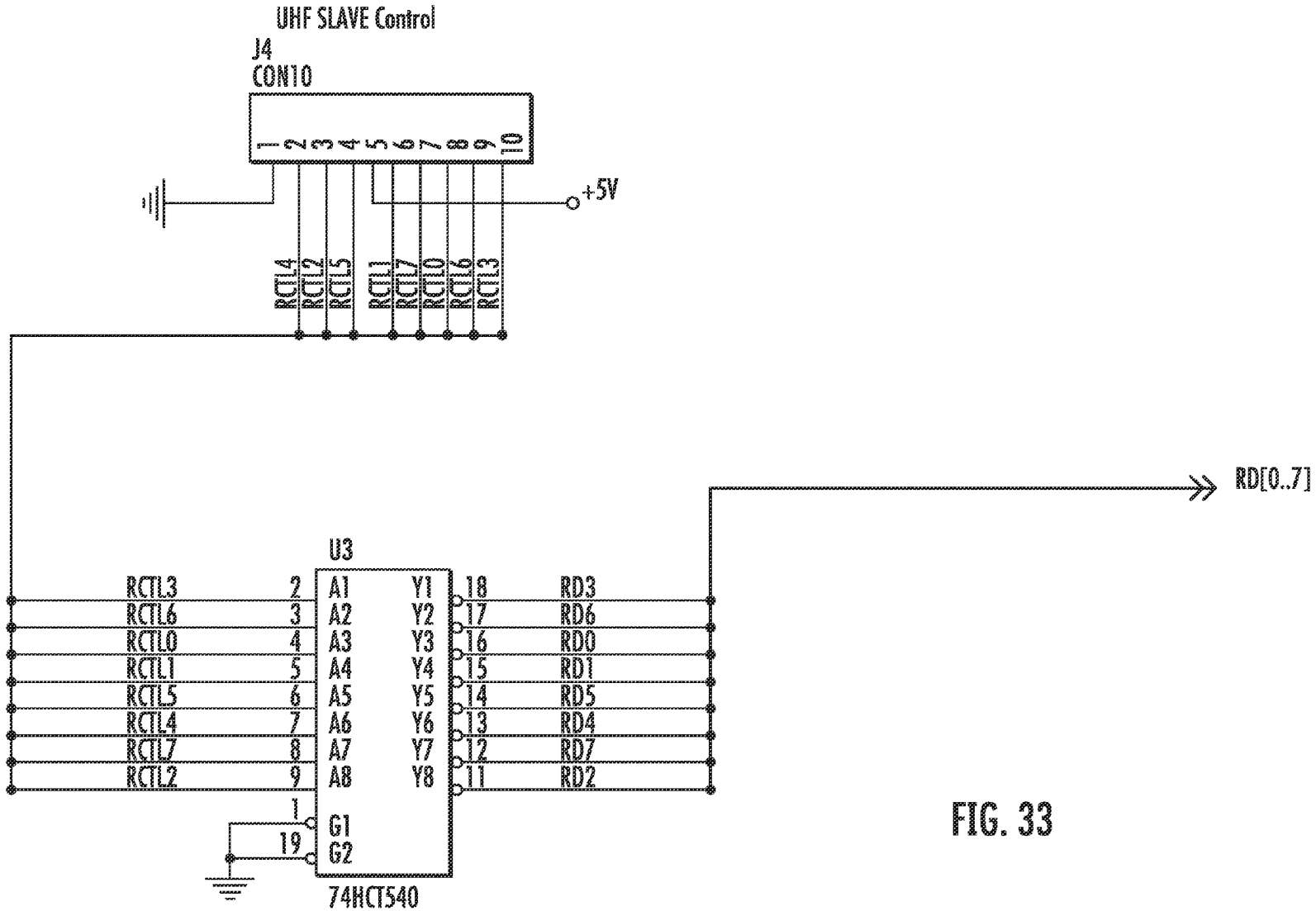
FIG. 33 is a circuit diagram illustrating an exemplary slave panel relay that may be used with a smart antenna.

A description will now be provided of the functions of a smart antenna SLAVE panel configured in accordance with the exemplary circuit diagrams or schematics shown in FIGS. 33 through 36. FIG. 33 is a circuit diagram illustrating an exemplary SLAVE relay drive. U3 converts the 3.3V signals from the MASTER panel to 5V signals capable of driving the SLAVE tuning relays. J4 connects to the MASTER panel to receive the signals that tune this panel.

Figure 34:
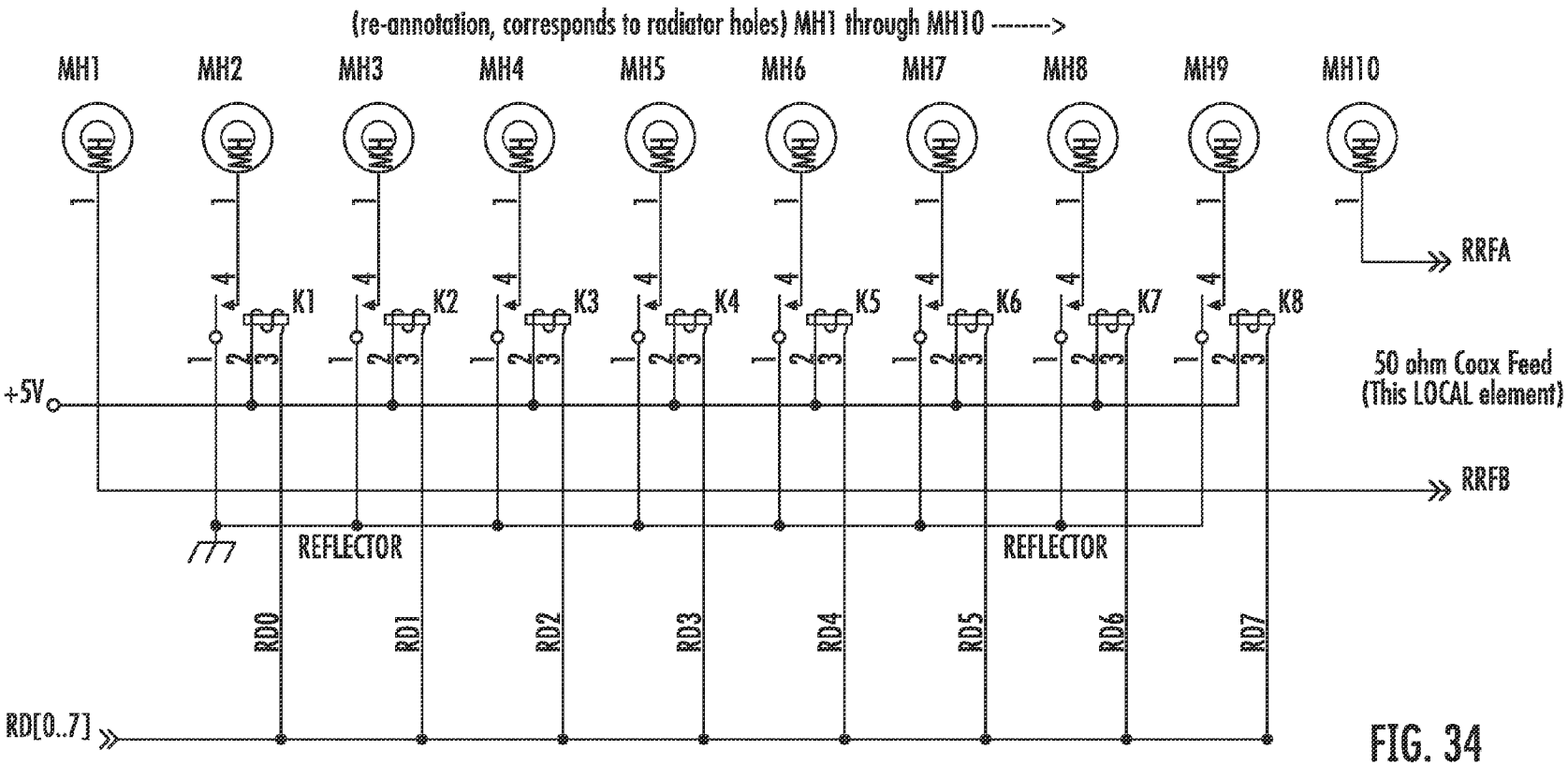
FIG. 34 is a circuit diagram illustrating exemplary slave antenna element tuning components that may be used with a smart antenna.

FIG. 34 is a circuit diagram illustrating exemplary slave antenna element tuning components. A smart antenna is tuned by activating shorting paths in the elements to change the electrical length. Relays K1 through K8 provide the shorting function.

Figure 35:
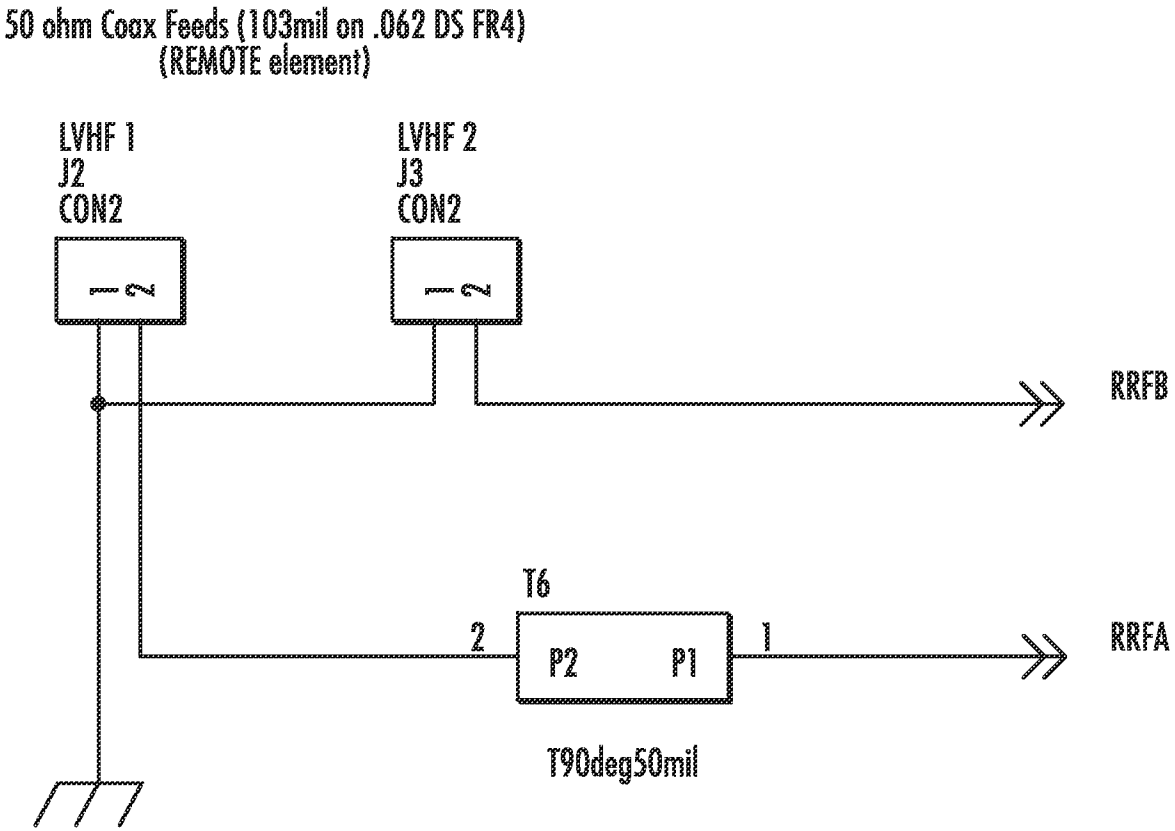
FIG. 35 is a circuit diagram illustrating an exemplary slave connection to the master RF inputs that may be used with a smart antenna.

FIG. 35 is a circuit diagram illustrating an exemplary slave connection to the master RF inputs. J2 and J3 are the connection points for the MASTER horizontal and vertical inputs respectively.

Figure 36:
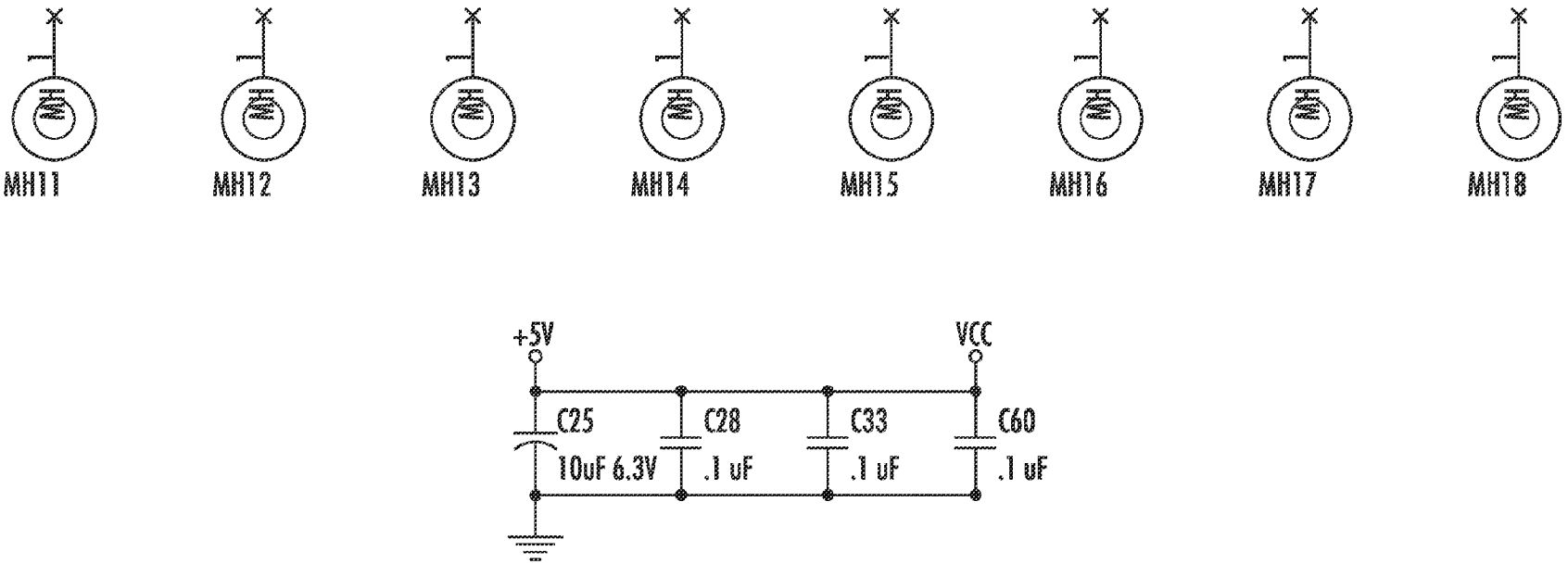
FIG. 36 is a circuit diagram illustrating exemplary decoupling logistics that may be used with a smart antenna, where the capacitors help dissipate noise from the active components of the slave panel.

FIG. 36 is a circuit diagram illustrating exemplary decoupling logistics. The capacitors dissipate noise from the active components on the SLAVE panel. Eight additional, electrically isolated mounting holes are also included.

FIG. 37 is a circuit diagram illustrating a 909 to 909A converter test fixture. The purpose of the test fixture is to add the data signaling to the +12VDC power supply, thus creating a 909A power and data stream. RF propagation through the dongle, while possible, would only further mask the smart antenna performance.

The test fixture is used to test the 909A data signal detection circuitry. The 909 interface is used for RF testing. Since the 909A data interface is within the smart antenna and thus always connected, the RF degradation would be constant or substantially constant. FIG. 37 depicts the 909 to 909A converter test dongle schematic in which JR1 is the 909 interface modular jack. The +12VDC power source on the 909 interface is detected by an LED placed in J19.

Two 500 mA or greater, variable bench supplies are attached to J20 and PS1. The J20 supply is the primary +12V DC power source. A voltage of about 13.6VDC is capable of overcoming the voltage drops of the driver circuit. The PS1 supply is the data signaling power source. Signaling is nominally 0 to +5VDC on top of the +12VDC bulk supply. By varying the pair of supplies, a wide range of power and signaling conditions may be generated. An oscilloscope may be used to verify the output S909A. R5, along with the current limit R29 and base capacitance discharge resistor R32, drive the transistor Q2. The collector voltage divider R28/R31 provides a signaling level scaled to the +12V to +18V driver Q4. D9 provides additional collector to base voltage breakdown safety. Q1 and Q3 provide the power drive for the S909A signal and represent a common emitter driver, placing the load in a position of negative feedback, to help protect the drive and simplify the driver circuit. The near common base provides a purposeful 1.4V crossover distortion to avoid or inhibit both transistors from conducting at the same time, thus shorting the +5V supply.

To maintain saturation, the diodes D5, D6, D7, and D8 help guarantee that base drive always exists for the drive transistors. R30 and R34 limit the base current for each drive transistor. C19 and C20 lower the frequency response below the drive transistor cutoff frequency, avoiding oscillation while driving capacitive loads. Because the power supplies only source (conventional) current, pulling the Signal from +18V to +12V is performed solely by the load. This may result in a slow falling edge decay, artificially lengthening the data pulse. Additional resistive load may be used for light loads to discharge smart antenna capacitance.

FIG. 38 is a block diagram illustrating an exemplary complex programmable logic device (CPLD). Using the signals listed, the CPLD may be perform the following functions: 909/909A signal selection (S909, S909A, EN909, SDATA); data message detection and validation (SYNC, START); valid message storage (D[0-15]); valid message decoding; direction to smart antenna panel selection (SCTRL[0-5], LCTRL[0-7], RCTRL[0-7]); polarization selection (SCTRL [0-5]); gain to attenuation mapping (ATTN[0-3]); channel to frequency tuning (LCTRL[0-7], RCTRL[0-7]); and/or LED display data source (D[0-15]).

Because of the quantity of logic and I/O pins, the total design is broken into two separate CPLDs in this example. The EN909 signal is derived from the 909 interface +12V power supply. When active, the S909 data source is selected, otherwise the S909A data source is selected. The selected data source is output as the SDATA signal. The SDATA signal is applied to the serial shift register. The positive edges of the SDATA comprise the 8 KHz signaling clock, and the trailing edges determine the data to be either a one (1) or a zero (0). The first bit is the SYNC bit. Its timing is atypical, but represents a one (1) in any case. The START bit is next and represents a standard one (1) data bit. Fourteen data bits follow the SYNC and the START bits. All sixteen bits are retained, and if the SYNC and START bits shift to the far end of the shift register, they indicate the proper number of bits were received and the message is 'Valid'. Valid messages are parallel transferred into the data register. This data is retained until overwritten by the next valid message. The shift register is cleared 2 mS after the last clock edge is received.

Registered data propagates to the RF signal path controls. Channel information is simultaneously compared against 16 channel windows. A window is defined as the lowest and highest channel number that represents a specific tuning pattern. Should a channel match the low limit, match the high limit or exist between those limits, that tuning pattern is applied to the antenna. Since only one state may be applied to the smart antenna at one time, the channel ranges may not overlap for proper operation.

The tuning patterns are additionally qualified by the desired polarization and direction data. Unused polarizations and directions are forced to zeros (0s) to minimize or reduce power supply current demands. Since the tuning patterns correspond to channel and frequency, they are also used, along with polarization and direction, to operate the band switching functions of the smart antenna.

Finally, the gain data is mapped into settings which operate the RF signal attenuators.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention. In addition, dimensions provided herein are mere examples provided for purposes of illustration only, as any of the disclosed embodiments may be configured with different dimensions depending, for example, on the particular application and/or signals to be received or transmitted.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A reconfigurable antenna array for reception of digital television signals, the antenna array comprising:

a first ground plane;

a first electrically-conductive microstrip patch element spaced apart from the ground plane with a dielectric medium between the patch element and the ground plane;

a first plurality of switches coupled between the ground plane and the patch element, the plurality of switches operable to open and close;

a second ground plane;

a second electrically-conductive microstrip patch element spaced apart from the second ground plane with a second dielectric medium between the second patch element and the second ground plane;

a second plurality of switches coupled between the second ground plane and the second patch element, the second plurality of switches operable to open and close;

wherein the first and second patch elements are configured in a master-slave relationship; and whereby the switches are openable and closable in response to a control signal from an external device to configure the state of the reconfigurable antenna.

2. The reconfigurable antenna array of claim 1 further comprising a controller operable for opening and closing the plurality of switches in response to the control signal from the external device that is received by the controller.

3. The reconfigurable antenna array of claim 2 wherein the controller is operable to selectively change the resonant frequency and/or the polarization state in response to the control signal.

4. The reconfigurable antenna array of claim 2 wherein the controller is operable for selectively coupling the first patch element and/or the second patch element to the external device in response to the control signal.

5. The reconfigurable antenna array of claim 2 wherein the external device is one of a television, a receiver, and a converter.

6. The reconfigurable antenna array of claim 1 wherein:

the reconfigurable antenna is configured for receiving ultra high frequency (UHF) signals; and/or at least one the first and second patch elements have a generally circular shape; and/or at least one of the first and second dielectric mediums is air; and/or at least one of the first and second patch elements is spaced-apart from the corresponding first and second ground planes a distance of about 25 millimeters.

7. The reconfigurable antenna array of claim 1 wherein the first and second patch elements comprise low-profile dual-polarized tunable microstrip disc elements.

8. The reconfigurable antenna array of claim 1 wherein the reconfigurable antenna array is configured to be in compliance with the CEA-909A single wire control interface standard and/or to fit in a form factor smaller than 20 inches×10 inches×12 inches (or equivalently 50.8 centimeters×25.4 centimeters×30.5 centimeters).

9. The reconfigurable antenna array of claim 1 wherein the switches are each coupled to a corresponding point on the first or second patch element, for shorting the corresponding point to the first or second ground plane when said switch is closed.

10. The antenna array of claim 1 wherein the first and second patch elements are configured to radiate in different directions.

11. A reconfigurable antenna array for reception of digital television signals, the antenna array comprising:

a first ground plane;

a first electrically-conductive microstrip patch element spaced apart from the ground plane with a dielectric medium between the patch element and the ground plane;

a first plurality of switches coupled between the ground plane and the patch element, the plurality of switches operable to open and close; and a second ground plane;

a second electrically-conductive microstrip patch element spaced apart from the second ground plane with a second dielectric medium between the second patch element and the second ground plane;

a second plurality of switches coupled between the second ground plane and the second patch element, the second plurality of switches operable to open and close;

whereby the switches are openable and closable in response to a control signal from an external device to configure the state of the reconfigurable antenna;

wherein the first and second patch elements, ground planes, and switches are mounted in corresponding first and second picture frames hinged along a vertical edge thereof, whereby the reconfigurable antenna array is capable of directing a beam in two different directions depending on orientation and hinge angle.

12. A reconfigurable antenna array for reception of digital television signals, the antenna array comprising:

a first ground plane;

a first electrically-conductive microstrip patch element spaced apart from the ground plane with a dielectric medium between the patch element and the ground plane;

a first plurality of switches coupled between the ground plane and the patch element, the plurality of switches operable to open and close; and a second ground plane;

a second electrically-conductive microstrip patch element spaced apart from the second ground plane with a second dielectric medium between the second patch element and the second ground plane;

a second plurality of switches coupled between the second ground plane and the second patch element, the second plurality of switches operable to open and close;

whereby the switches are openable and closable in response to a control signal from an external device to configure the state of the reconfigurable antenna;

wherein each of the first and second patch elements is dual polarized and has 16 tuning states for each polarization.

13. The reconfigurable antenna array of claim 12 wherein the first and second patch elements are configured in a master-slave relationship.

14. The reconfigurable antenna array of claim 12 further comprising at least one switch for selecting the strongest signal from among the polarization states available in each of the first and second patch elements.

15. A reconfigurable antenna comprising:

a ground plane;

an electrically-conductive microstrip patch element spaced-apart from the ground plane with a dielectric medium between the patch element and the ground plane; and a plurality of switches coupled to a corresponding plurality of points on the patch element, each one of the plurality of switches operable for shorting a corresponding one of the plurality of points to the ground plane when said switch is closed;

wherein the plurality of switches includes a first group of switches and a second group of switches, the first group of switches connected to a first group of the plurality of points forming a generally straight first line, the second group of switches connected to a second group of the plurality of points forming a generally straight second line.

16. The reconfigurable antenna of claim 15 wherein the reconfigurable antenna has a first resonant frequency when all of the plurality of switches are open and at least a second resonant frequency when at least one of the plurality of switches is closed.

17. The reconfigurable antenna of claim 15 wherein the plurality of switches is n switches and the reconfigurable antenna has $2^n$ selectable resonant frequencies, where n is a whole number greater than 1.

18. The reconfigurable antenna of claim 15 wherein the first group of switches consists of m switches and the second group of switches consists of n switches, and the reconfigurable antenna has $2^m$ selectable resonant frequencies in a first polarization state and $2^n$ selectable resonant frequencies in a second polarization state, where m and n are whole numbers greater than 1.

19. The reconfigurable antenna of claim 18 wherein the second line is substantially perpendicular to the first line.

20. The reconfigurable antenna of claim 19 wherein the reconfigurable antenna is configured such that opening all of the first group of switches and closing at least one of the second group of switches configures a first polarization state, and such that opening all of the second group of switches and closing at least one of the first group of switches configures a second polarization state.

21. The reconfigurable antenna of claim 15 wherein the first line traverses along a first linear direction including a first feed point of the patch element and a center of the patch element and/or along a second linear direction including a second feed point of the patch element and the center of the patch element.

22. The reconfigurable antenna of claim 15 wherein:

the dielectric medium is air; and/or the patch element has a generally circular shape; and/or the patch element is spaced-apart from the ground plane a distance of about 25 millimeters.

23. The reconfigurable antenna of claim 15 further comprising a controller operable for opening and closing the plurality of switches in response to a control signal from an external television device to configure the state of the reconfigurable antenna.

24. The reconfigurable antenna of claim 15 wherein the patch element comprises a dual-polarized tunable microstrip disc element.

25. An antenna array comprising a plurality of the reconfigurable antennas of claim 15, and configured for receiving digital television signals.

26. A reconfigurable antenna comprising:

a ground plane;

an electrically-conductive microstrip patch element spaced-apart from the ground plane with a dielectric medium between the patch element and the ground plane; and a plurality of switches coupled to a corresponding plurality of points on the patch element, each one of the plurality of switches operable for shorting a corresponding one of the plurality of points to the ground plane when said switch is closed;

wherein the plurality of switches includes a first group of four switches each of which is coupled to a corresponding one of four points forming a first line and a second group of four switches each of which is coupled to a corresponding one of four points forming a second line, the first line generally perpendicular to the second line, and the reconfigurable antenna has a sixteen selectable tuning states in a first polarization state and sixteen selectable tuning states in a second polarization state.

27. The reconfigurable antenna of claim 26 wherein the selectable tuning states have a resonant frequency in a range of 400 megahertz to 800 megahertz.

28. An antenna for receiving television signals, the antenna comprising:

a plurality of antenna elements, each having a primary radiation direction, the plurality of antenna elements oriented such that the primary radiation direction of at least a first antenna element of the plurality of antenna elements is a first direction and the primary radiation direction of at least a second antenna element of the plurality of antenna elements is a second direction; and a controller operable for configuring a state of the antenna in response to a control signal from an external television device;

wherein the first and second antenna elements are configured in a master-slave relationship.

29. The antenna of claim 28 wherein the state of the antenna includes an antenna radiation direction and the controller is configured to configure the antenna radiation direction by selectively coupling one of the first antenna element and the second antenna element to the external television device.

30. The antenna of claim 28 wherein the state of the antenna includes a desired radiation direction and the controller is configured to control the phase relationship between the plurality of antenna elements to achieve a higher gain in the desired radiation direction.

31. The antenna of claim 28 wherein each of the antenna elements comprises a dual-polarized tunable microstrip disc element spaced apart from a ground plane with a dielectric medium between and coupled to the ground plane by a plurality of openable/closable switches.

32. The antenna of claim 31 wherein at least one of the antenna elements comprises a cavity backed slot antenna element.

33. The antenna of claim 32 wherein the cavity backed slot antenna comprises an electrically-conductive cavity having a bottom surface and an upper surface defining an opening, an antenna element spaced above the bottom surface of the cavity such that a slot is defined generally between the antenna element and the portion of the upper surface defining the opening, whereby the cavity backed slot antenna radiates primarily toward the opening of the electrically-conductive cavity and is reconfigurable by loading the slot and/or the electrically-conductive cavity.

34. The antenna of claim 33 wherein:

the slot is generally circular; and/or the cavity backed slot antenna element is fed by a T-bar feed; and/or the cavity backed slot antenna element is configured for receiving ultra high frequency (UHF) signals.

35. The antenna of claim 31 wherein the controller is operable to configure a state of any the dual-polarized tunable microstrip disc elements in response to the control signal.

36. The antenna of claim 31 wherein the controller is operable to selectively change the resonant frequency, polarization state, and/or radiation direction of any of the dual-polarized tunable microstrip disc elements in response to the control signal.

37. An antenna module for an antenna for receiving television signals, the module comprising:

a housing;

an antenna element within the housing;

a controller operable for configuring a state of the antenna element in response to a control signal from an external television device; and an interface for communicatively coupling the module to one or more like antenna modules in a master-slave relationship.

38. The antenna module of claim 37 wherein the antenna element is a reconfigurable antenna element having a plurality of operating states, the controller operable to configure the reconfigurable antenna element in the plurality of operating states.

39. The antenna module of claim 37 wherein the antenna element is not a reconfigurable antenna element and the controller is operable for selectively coupling the antenna module or an additional antenna module to an external television receiver.

40. An antenna for receiving television signals including the antenna module of claim 37 and at least one additional like antenna module communicatively coupled to the antenna module.

41. The antenna of claim 40 wherein the at least one additional like antenna module does not include a controller.

42. The antenna module of claim 37 wherein the housing is configured for interlocking connection with like antenna modules.

* * * * *